US012654088B2

(12) United States Patent
Ahearn et al.

(10) Patent No.: US 12,654,088 B2
(45) Date of Patent: Jun. 16, 2026

(54) GOLF PUTTING DEVICES, SYSTEMS, METHODS AND MEDIA

(71) Applicant: GREEN TALLY, LLC, Creve Coeur, MO (US)

(72) Inventors: Blake Ahearn, St. Louis, MO (US); Reilly Ahearn, St. Louis, MO (US); Sam Ristich, Los Angeles, CA (US)

(73) Assignee: GREEN TALLY, LLC, Creve Coeur, MO (US)

( * ) Notice: Subject to any disclaimer, the term of this patent is extended or adjusted under 35 U.S.C. 154(b) by 0 days.

(21) Appl. No.: 18/886,347

(22) Filed: Sep. 16, 2024

(65) Prior Publication Data

US 2025/0090931 A1 Mar. 20, 2025

Related U.S. Application Data

(60) Provisional application No. 63/538,613, filed on Sep. 15, 2023, provisional application No. 63/677,801, filed on Jul. 31, 2024.

(51) Int. Cl.
*A63B 57/40* (2015.01)
*A63B 71/06* (2006.01)

(52) U.S. Cl.
CPC ..... *A63B 71/0605* (2013.01); *A63B 57/40* (2015.10); *A63B 71/0622* (2013.01); *A63B 2071/0625* (2013.01); *A63B 2220/17* (2013.01); *A63B 2220/40* (2013.01); *A63B 2220/807* (2013.01); *A63B 2220/833* (2013.01); *A63B 2220/89* (2013.01); *A63B 2225/50* (2013.01)

(58) Field of Classification Search
CPC .. A63B 71/0605; A63B 71/0622; A63B 57/40
See application file for complete search history.

(56) References Cited

U.S. PATENT DOCUMENTS 4,563,009 A * 1/1986 Nagasaki ..... A63B 57/405 473/183
4,922,222 A * 5/1990 Baker ..... A63B 24/0021 340/323 R (Continued)

FOREIGN PATENT DOCUMENTS

KR 101654080 B1 9/2016
WO WO-2019198909 A1 10/2019

*Primary Examiner* — James S. McClellan
(74) *Attorney, Agent, or Firm* — Harness, Dickey & Pierce, P.L.C.

(57) ABSTRACT

A golf putting system according to one embodiment includes a putt detector and a cup detector. The putt detector includes one or more sensors and a control circuit to detect when golf balls are putted. The cup detector includes one or more sensors and a control circuit to detect when golf balls enter a putting hole. The putt detector and the cup detector are configured for wireless communication with one another. The putt detector is configured to determine the number of putts taken and the number of putts made during a putting session in response to the putt detector detecting when golf balls are putted and the cup detector detecting when golf balls enter the putting hole. Optionally, the system may determine and display the distance between the putt detector and the cup detector. Other systems, devices, methods and computer-readable media are also disclosed.

21 Claims, 30 Drawing Sheets

(56) References Cited

U.S. PATENT DOCUMENTS

| | | | | |
|---|---|---|---|---|
| 5,788,583 | A * | 8/1998 | Agulnek | A63B 69/3676 473/407 |
| 5,884,913 | A * | 3/1999 | Cohen | A63B 69/3694 473/192 |
| 6,193,613 | B1 * | 2/2001 | Alexandres | A63B 57/405 473/183 |
| 7,255,649 | B1 * | 8/2007 | McConnell | A63B 69/3658 473/199 |
| 8,449,409 | B1 * | 5/2013 | Barkley | G01S 17/89 473/404 |
| 9,597,576 | B2 | 3/2017 | Peterson et al. | |
| 2006/0029916 | A1 * | 2/2006 | Boscha | A63B 69/3614 434/252 |
| 2008/0009359 | A1 * | 1/2008 | Yun | A63B 69/3676 473/152 |
| 2010/0087266 | A1 * | 4/2010 | Nicodem | A63B 69/3614 473/409 |
| 2017/0007902 | A1 | 1/2017 | Cottam et al. | |
| 2019/0255418 | A1 * | 8/2019 | Seo | A63B 69/3605 |
| 2021/0069548 | A1 * | 3/2021 | Beach | A63B 24/0006 |
| 2021/0260451 | A1 * | 8/2021 | Belton | A63B 57/405 |
| 2022/0126187 | A1 | 4/2022 | Hong | |
| 2022/0288479 | A1 * | 9/2022 | Won | G06F 3/011 |
| 2022/0355176 | A1 | 11/2022 | Hollomon et al. | |

* cited by examiner

GOLF PUTTING DEVICES, SYSTEMS, METHODS AND MEDIA

CROSS-REFERENCE TO RELATED APPLICATIONS

This application claims the benefit of U.S. Provisional Application No. 63/538,613 filed Sep. 15, 2023, and U.S. Provisional Application No. 63/677,801 filed Jul. 31, 2024. The entire disclosures of each of the above applications are incorporated herein by reference.

FIELD

The present disclosure relates to the game of golf and, more particularly, to golf putting devices, systems, methods and non-transitory computer readable media.

BACKGROUND

This section provides background information related to the present disclosure which is not necessarily prior art.

Putting is one of the most important aspects in the game of golf and vital to achieving better golf scores. Eliminating even a few putts can save a golfer three or four strokes every round. For this reason, competitive golfers regularly practice their putting.

Typically, golfers practice putting by stepping off or measuring a certain distance from a putting hole, usually ranging from three to twenty feet, and marking that spot with a golf tee or other item. After the spot is marked, the player putts a number of balls and keeps track of how many go into the hole ("makes") as compared to the total number of putts taken ("putts" or "attempts"). The player will repeat this process multiple times, hitting balls from various locations to improve their putting at various distances from the hole.

SUMMARY

This section provides a general summary of the disclosure, and is not a comprehensive disclosure of its full scope or all of its features.

According to one aspect of the present disclosure, a golf putting system includes a putt detector and a cup detector. The putt detector includes one or more sensors and a control circuit to detect when golf balls are putted. The cup detector includes one or more sensors and a control circuit to detect when golf balls enter a putting hole. The putt detector and the cup detector are configured for wireless communication with one another. The putt detector is configured to determine the number of putts taken and the number of putts made in response to the putt detector detecting when golf balls are putted and the cup detector detecting when golf balls enter the putting hole.

Additionally, or alternatively, the cup detector is removably attachable to the putt detector.

Additionally, or alternatively, the system is configured to wirelessly charge the cup detector when the cup detector is detachably stowed on the putt detector.

Additionally, or alternatively, the one or more sensors of the putt detector include a radar sensor or a 2D camera.

Additionally, or alternatively, the one or more sensors of the cup detector include a piezoelectric sensor or an accelerometer.

Additionally, or alternatively, the system includes a smart device configured for wireless communication with the putt detector and/or the cup detector.

Additionally, or alternatively, the smart device includes an application (computer instructions) configured to store, process and/or display putting information received from the putt detector and/or the cup detector for one or more individuals.

Additionally, or alternatively, the putt detector is configured to wirelessly transmit putting information to a smart device.

Additionally, or alternatively, the putt detector, the cup detector or the smart device includes a display and is configured to display the number of putts taken and the number of putts made.

Additionally, or alternatively, the system is configured to determine a distance between the putt detector and the cup detector.

Additionally, or alternatively, the system is configured to determine the distance between the putt detector and the cup detector using ultra-wideband positioning.

Additionally, or alternatively, the putt detector, the cup detector or the smart device includes a display and is configured to display the distance between the putt detector and the cup detector.

Additionally, or alternatively, the putt detector includes an accelerometer for detecting movement of the putt detector, and the putt detector is configured to determine the distance between putt detector and the cup detector within a defined time period after the putt detector becomes stationary.

Additionally, or alternatively, the putt detector, the cup detector or the smart device is configured to display the number of putts taken and the number of putts made by distance.

Additionally, or alternatively, the putt detector, the cup detector or the smart device is configured to display putting accuracy based on the number of putts taken and the number of putts made.

Additionally, or alternatively, the putt detector, the cup detector or the smart device is configured to display putting accuracy by distance.

Additionally, or alternatively, the putt detector is configured to determine the ball speed when putted.

Additionally, or alternatively, the system is configured to use the ball speed to calculate the ball's arrival time at the hole, and to use the calculated arrival time to determine whether a putt was made.

According to another aspect of the present disclosure, an apparatus incudes one or more sensors and a control circuit to detect when golf balls are putted, and a wireless communication module configured to receive from another device data indicating when golf balls enter a putting hole. The control circuit is coupled to the wireless communication module and configured to determine a number of putts taken and a number of putts made in response to detecting when golf balls are putted and the data indicating when golf balls enter the putting hole.

Additionally, or alternatively, the one or more sensors include a radar sensor or a 2D camera.

Additionally, or alternatively, the apparatus is configured to wirelessly transmit putting information to a smart device.

Additionally, or alternatively, the apparatus includes a display for displaying the number of putts taken and the number of putts made.

Additionally, or alternatively, the apparatus is configured to determine and display a distance to the putting hole.

Additionally, or alternatively, the apparatus includes a UWB initiator.

Additionally, or alternatively, the apparatus includes an accelerometer for detecting movement and is configured to determine the distance to the putting hole within a defined time period after the apparatus becomes stationary.

According to yet another aspect of the present disclosure, an apparatus includes one or more sensors and a control circuit to detect when golf balls enter a putting hole, and a wireless communication module configured to send wireless data to another device indicating when golf balls enter the putting hole. The apparatus is configured to send a wireless signal to said another device that enables said another device to determine a distance between said another device and the apparatus.

Additionally, or alternatively, the one or more sensors include a piezoelectric sensor or an accelerometer.

Additionally, or alternatively, the apparatus includes a UWB responder for sending the wireless signal.

Additionally, or alternatively, the apparatus is sized and configured for placement over the flagstick hole of a conventional golf cup.

Additionally, or alternatively, the apparatus includes a speaker for providing user feedback.

According to still another aspect of the present disclosure, a golf putting system includes means for detecting when golf balls are putted, means for detecting when golf balls enter a putting hole, means for determining a number of putts taken and a number of putts made, and means for displaying the number of putts taken and the number of putts made.

Additionally, or alternatively, the system includes means for determining a distance between where the golf balls are putted and the putting hole.

According to another aspect of the present disclosure, a golf putting system includes a putt marker, a hole marker, means for determining a distance between the putt marker and the hole marker, and means for displaying the determined distance.

According to still another aspect of the present disclosure, a method includes detecting when golf balls are putted, receiving from another device data indicating when golf balls enter a putting hole, and determining a number of putts taken and a number of putts made in response to detecting when golf balls are putted and the data indicating when golf balls enter the putting hole.

According to yet another aspect of the present disclosure, a method includes receiving putting information wirelessly from a remote device, storing the received putting information, processing the received putting information and/or displaying the received or processed putting information.

According to further aspects of the present disclosure, a non-transitory computer readable medium stores instructions that, when executed by a processor, cause it to perform any of the various methods disclosed herein.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
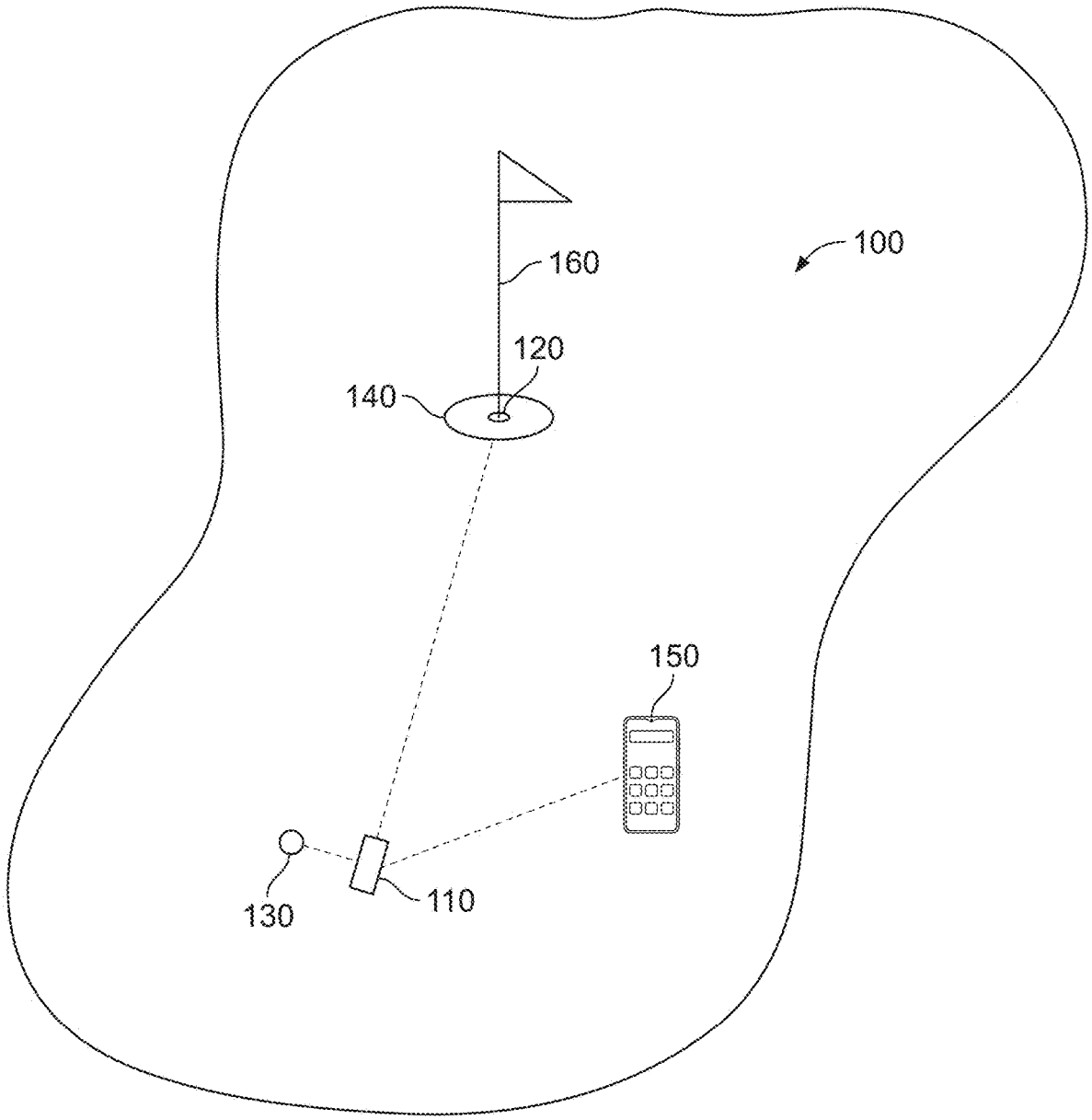
FIG. 1 illustrates a golf putting system according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A golf putting system according to one example embodiment of the present disclosure is illustrated in FIG. 1 and designated generally by reference numeral 100. As shown in FIG. 1, the system 100 includes a putt detector 110 and a cup detector 120. The putt detector 110 may be placed on the putting surface adjacent a golf ball 130. The putt detector 110 includes one or more sensors and a control circuit to detect when golf balls are putted. The cup detector 120 may be positioned in or near a putting hole 140 and includes one or more sensors and a control circuit to detect when golf balls enter the putting hole 140. The system 100 is configured to determine a number of putts taken and a number of putts made in response to the putt detector 110 detecting when golf balls are putted and the cup detector 120 detecting when golf balls enter the putting hole.

In the example embodiment shown in FIG. 1, the putt detector 110 and the cup detector 120 are configured for wireless communication with one another using any suitable communication network or protocol (e.g., Bluetooth, WiFi, UWB, etc.). Further, the cup detector 120 is configured to transmit to the putt detector 110 data indicating when golf balls enter the putting hole 140. The putt detector 110 is configured to determine a number of putts taken and a number of putts made in response to the putt detector 110 detecting when golf balls are putted and the data indicating when golf balls enter the putting hole 140.

Further, the putt detector 110 may be configured to store, display and/or transmit the number of putts taken and the number of putts made. The putt detector 110 may also be configured for wireless communication with a smart device 150 using any suitable communication network or protocol (e.g., Bluetooth, WiFi, etc.). The smart device 150 may be configured to receive, store, display and/or transmit the number of putts taken and the number of putts made in addition to (or instead of) the putt detector 110. In this manner, the system 100 can be used to automatically track the number of putts taken and the number of putts made during one or more golf putting practice sessions. The system 100 may also be used during golf game(s) to track putts and makes by individual players.

Figure 2:
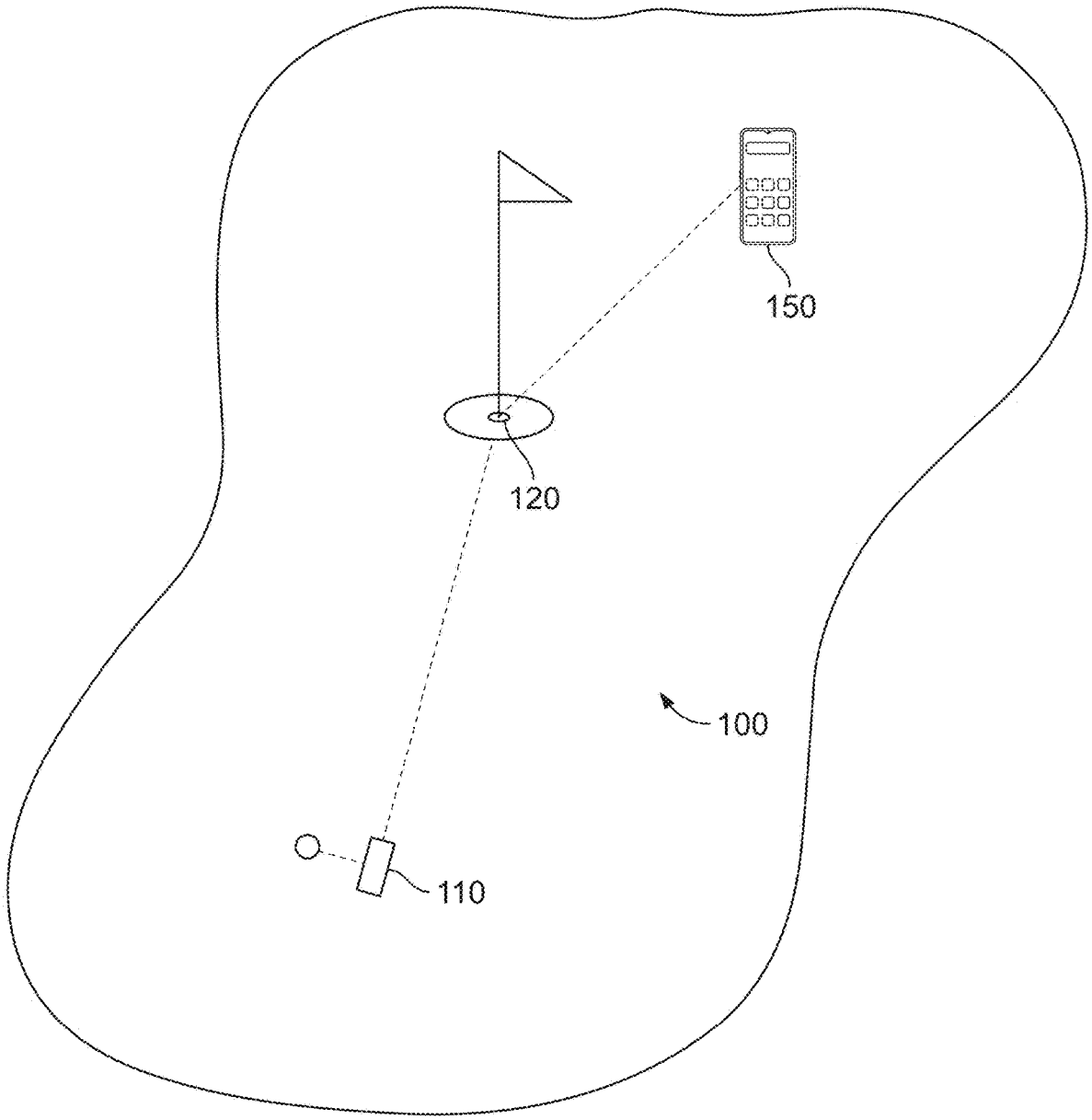
FIG. 2 illustrates a golf putting system according to another example embodiment of the present disclosure.

In another example embodiment shown in FIG. 2, the putt detector 110 is configured to transmit to the cup detector 120 data indicating when golf balls are putted. The cup detector 120 is configured to determine a number of putts taken and a number of putts made in response to the data indicating when golf balls are putted and the cup detector 120 detecting when golf balls enter the putting hole 140.

Further, the cup detector 120 may be configured to store, display and/or transmit the number of putts taken and the number of putts made. The cup detector 120 may also be configured for wireless communication with the smart device 150 using any suitable communication network or protocol. The smart device 150 may be configured to store, display and/or transmit the number of putts taken and the number of putts made in addition to (or instead of) the cup detector 120. In this manner, the system 100 can be used to automatically track the number of putts taken and the number of putts made during one or more golf putting sessions.

Figure 3:
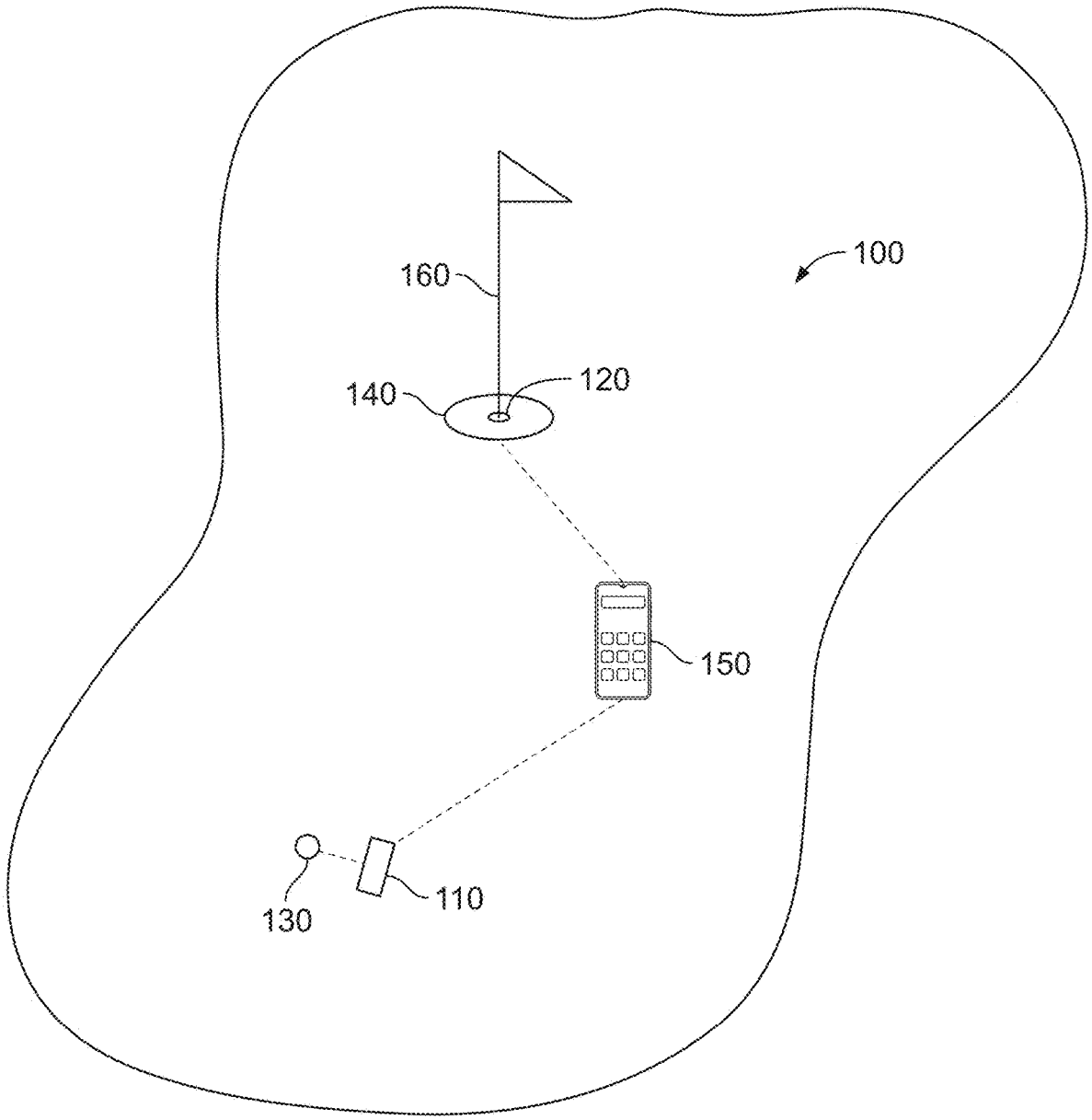
FIG. 3 illustrates a golf putting system according to yet another example embodiment.

In another example embodiment shown in FIG. 3, the putt detector 110 and the cup detector 120 are both configured for wireless communication with the smart device 150. Thus, the smart device 150 may be configured to receive data from the putt detector 110 and the cup detector 120, and to store, display and/or transmit the number of putts taken and the number of putts made. In the particular embodiment shown in FIG. 3, the putt detector 110 and the cup detector 120 are not configured for communication with one another.

Figure 4:
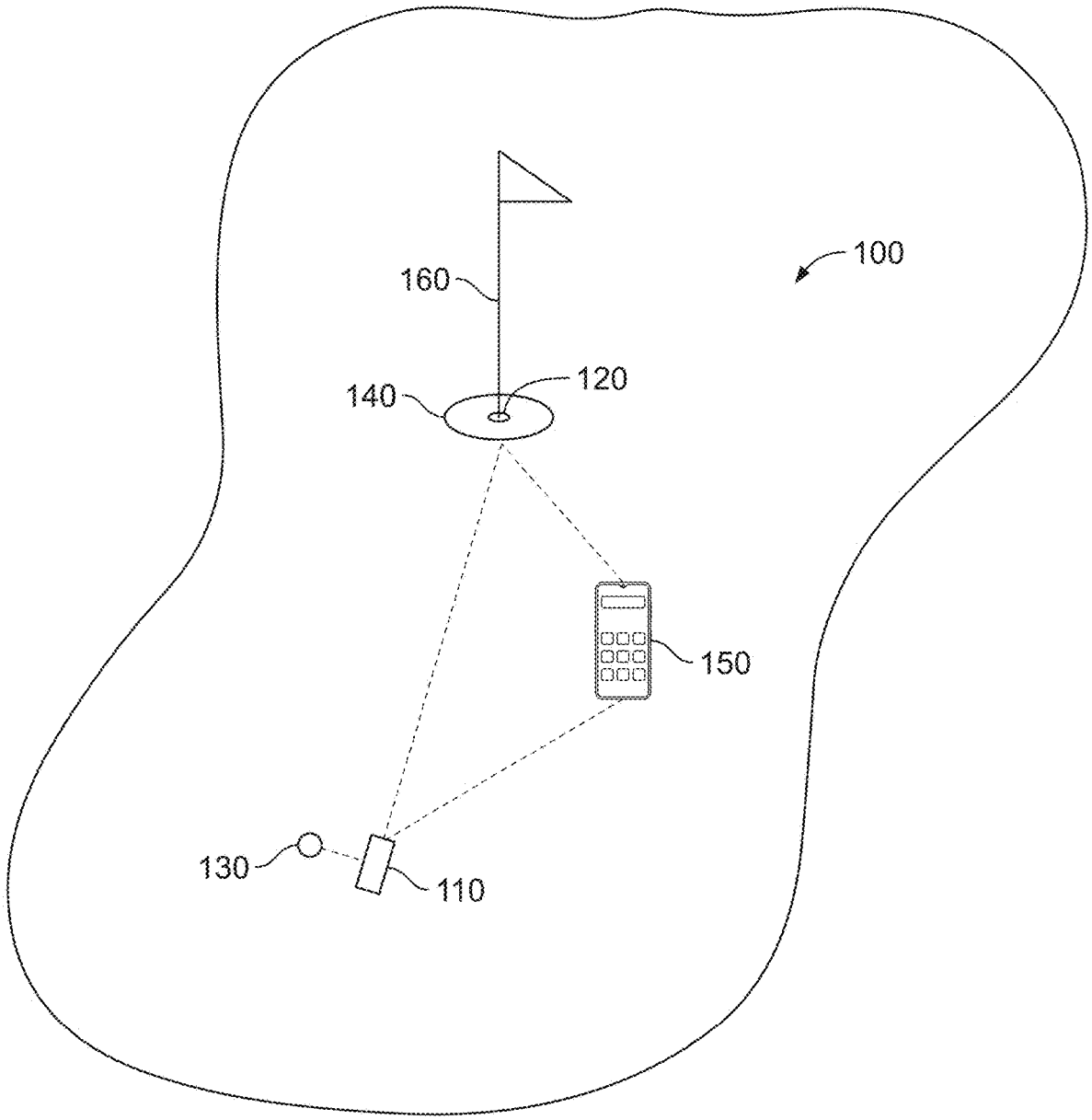
FIG. 4 illustrates a golf putting system according to another example embodiment of the present disclosure.

In another example embodiment shown in FIG. 4, the putt detector 110 and the cup detector 120 are configured for wireless communication with one another and with the smart device 150. Therefore, each device 110, 120, 150 may be configured to store, display and/or transmit the number of putts taken and the number of putts made.

Further, in any given embodiment of the present disclosure, each device 110, 120, 150 may be configured to process and/or combine the number of putts taken and the number of putts made in a current putting session with data from prior putting sessions, to generate and display putting data for a particular time period, putting location, putting device, etc.

As apparent to those skilled in the art, the smart device 150 preferably stores computer instructions in memory (i.e., a non-transitory computer readable medium such as RAM or ROM), e.g., in the form of a smartphone "app." When executed by a processor in the smart device 150, the computer instructions may cause the smart device 150 to store, process and/or display putting information for one or more individuals as described and illustrated herein. As used herein, the term "non-transitory" is a limitation of the medium itself (i.e., tangible, not a signal) as opposed to a limitation on data storage persistency (e.g., RAM vs. ROM).

Additionally, the smart device 150 may be configured for wireless communication (e.g., via WiFi, a cellular network, etc.) with a remote computer network or system (e.g., the "cloud") for allowing the app to transfer putting information to the remote network or system, and/or receive putting information from the remote network or system. The smart device 150 may take any desired form including, for example, a smartphone, a tablet pc, a smart watch, smart eyeglasses, etc.

In any given embodiment of these teachings, the putt detector 110, the cup detector 120 and/or the smart device 150 may include visual display(s) for displaying to a user the number of putts made and the number of putts taken. The visual display(s) may include a weatherproof tempered glass screen that is suitable for outdoor use in direct sunlight.

The putt detector 110 and the cup detector 120 may employ any suitable power source(s) including, for example, one or more replaceable batteries, one or more rechargeable batteries, solar panel(s), etc. In the event one or more rechargeable batteries are employed, the putt detector 110 and/or the cup detector 120 (as applicable) may further include a wireless charging module and/or an external charging port.

Figure 5:
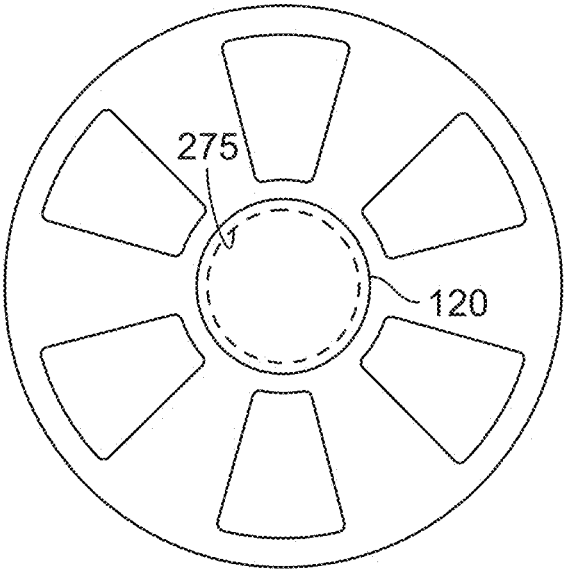
FIG. 5 is a top view of an example cup detector resting in a golf putting hole according to one example embodiment.

The cup detector 120 may take any desired form. For example, in some embodiments, the cup detector 120 has the same shape as a golf ball, and can be placed in or near the putting hole 140 for detecting when balls enter the putting hole. For example, and as shown in FIG. 5, the cup detector 120 may have a smaller size than a golf ball, so the cup detector 120 will fit in a standard putting hole/cup with at least four (putted) golf balls. In other embodiments, the cup detector 120 may be attached to or integrated with a golf flagstick. For example, in the example embodiments shown in FIGS. 1-4, the cup detector 120 may be coupled to the bottom or lower end of the flagstick 160. Alternatively, the cup detector 120 may be positioned at a higher elevation on the flagstick 160.

The cup detector 120 may utilize any suitable sensor(s) for detecting when golf balls enter the putting hole 140 including optical sensors, light sensors (including laser sensors and switches), impact sensors, piezoelectric sensors, accelerometers, audio sensors (e.g., a microphone), etc. Additionally, the cup detector 120 and the putt detector 110 may be configured to detachably stow the cup detector 120 on the putt detector 110 when not in use.

Figure 6:
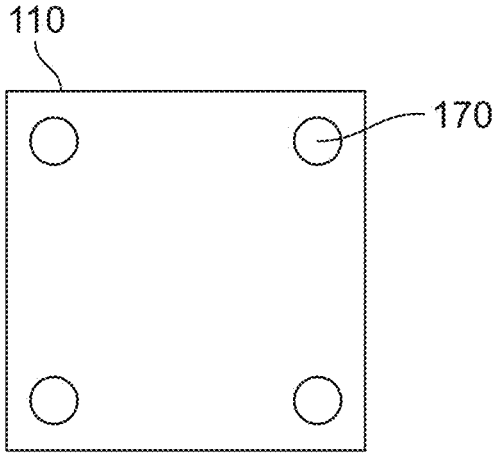
FIG. 6 is a bottom view of a putt detector with wheels or casters according to another example embodiment.

The putt detector 110 may also have any desired form. In some embodiments, the putt detector 110 may have a size and shape comparable to a smartphone and include wheel(s) or caster(s) 170, such as swivel or infinity wheels or casters, on its lower surface to facilitate movement of the putt detector 110 on a putting surface, as shown in FIG. 6. In some embodiments, the putt detector 110 may be moved from one position to another position using a golf putter. For this purpose, the putt detector 110 may include a surface configuration adapted for engagement by a golf putter.

Figure 7:
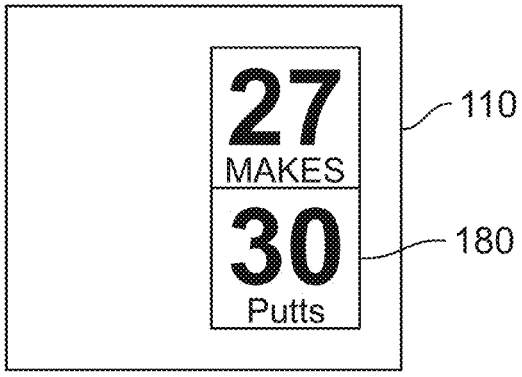
FIG. 7 is a top view of a putt detector configured to display the number of makes and putts according to another example embodiment.

The putt detector 110 may utilize any suitable sensor(s) for detecting when golf balls are putted including optical sensors, light sensors (including 2D and 3D cameras, laser sensors and switches), impact sensors, radar, lidar, audio sensors (e.g., a microphone), etc. Additionally, the putt detector 110 may include a visual indicator to signal when a golf ball is detected and ready for putting. As noted above, the putt detector 110 may also include a display 180 for visually displaying to a user the number of putts taken and the number of putts made, as shown in FIG. 7.

In some embodiments, the system 100 is configured to determine a distance between the putt detector 110 and the putting hole 140, in addition to (or instead of) tracking the number of putts taken and the number of putts made. Preferably, the system 100 is also configured to display the distance to the hole on the putt detector 110, the cup detector 120 and/or the smart device 150. Additionally, the system 100 may be configured to determine and display putts and makes, and/or accuracy (e.g., as a percentage of makes/putts) by distance to the hole. Furthermore, the system may permit the user to input or select a putting device (e.g., Putter #1, Putter #2, blade putter, mallet putter, etc.) and then track putts and makes and/or accuracy for that particular putting device, including by distance to the hole, location, user, etc.

The distance between the putt detector 110 and the putting hole 140 can be determined in a wide variety of ways. For example, the putt detector 110, the cup detector 120 and/or the smart device 150 can include a user interface through which the distance to the putting hole is entered by the user. As another option, the putt detector 110 may include a measuring wheel for measuring the distance traveled by the putt detector 110, e.g., from the putting hole 140 to a putting location. In that case, the putt detector 110 may also include a user input device by which a user can reset the measuring wheel before measuring the distance from the putting hole 140 to a subsequent putting location.

Preferably, the system 100 is configured to determine the distance between the putt detector 110 and the putting hole 140 automatically. This can be accomplished in a variety of ways. For example, the system 100 may employ Ultra-Wideband (UWB) positioning technology, e.g., a UWB positioning module, to determine the distance between the putt detector 110 and the cup detector 120. The cup detector 120 may therefore include a UWB anchor and the putt detector 110 may include a UWB tag, or vice versa. Further, the system 100 may utilize surface raster technology for determining the surface distance between the putt and cup detectors 110, 120 that takes into account putting surface undulations.

Figure 8:
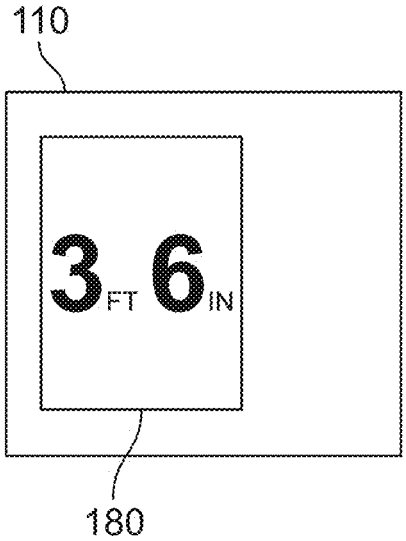
FIG. 8 is a top view of a putt detector or putt marker configured to display the distance to the hole/cup detector according to another example embodiment.
Figure 9:
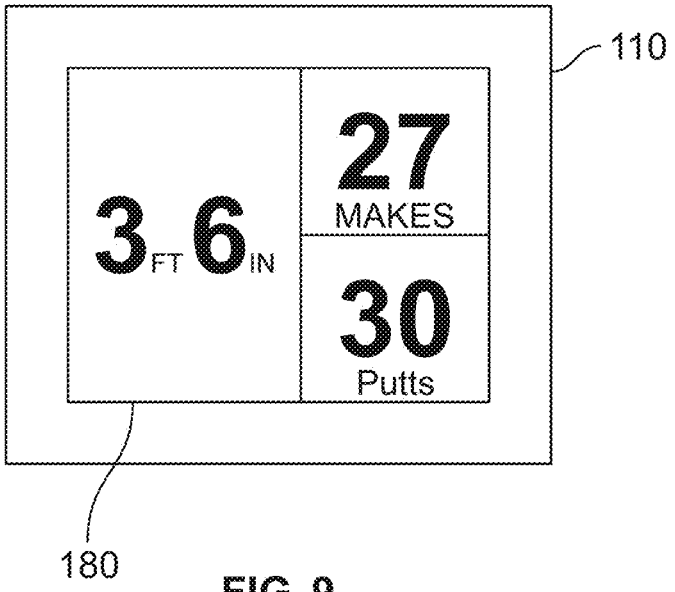
FIG. 9 is a top view of a putt detector configured to display the distance to the hole and the number of makes and putts from that distance according to another example embodiment.

Regardless of how determined, the putting distance is preferably displayed to the user via the putt detector 110, the cup detector 120 and/or the smart device 150. For example, the putt detector 110 may include a display 180 for visually displaying the distance to the cup, as shown in FIG. 8, or for visually displaying the distance to the cup as well as the number of putts taken and made, as shown in FIG. 9. Alternatively, the putt detector 110 (and/or the cup detector 120 and smart device 150) may display the number of putts taken and made as a percentage, and/or by distance to the putting hole (i.e., the number of putts/makes from three feet, four feet, ten feet, etc., or within ten feet of the putting hole, or within ten to fifteen feet of the putting hole, etc.).

In some embodiments, the putt detector 110 may also be configured to determine the ball speed when putted. Using the ball speed and the putting distance, the system 100 may calculate the golf ball's arrival time at the hole. The system 100 may use this information to determine whether a putt is made. For example, if the cup detector 120 does not detect a golf ball entering the hole at about the calculated arrival time, the system may interpret this as a "miss." Further, the system may use the calculated arrival time to distinguish the putted golf ball as it enters the hole from golf balls putted by other player(s) that enter the same hole at other times.

In certain alternative embodiments, the system 100 is configured to determine the distance between the putt detector 110 and the putting hole 140 without also tracking putts and makes. In these embodiments, the putt detector 110 and cup detector 120 can be considered a "putt marker" for marking the location of a golf ball to be putted on a putting surface, and a "hole marker" for marking the location of the putting hole. The system is configured to determine a distance between the putt marker and the hole marker using, e.g., UWB positioning. The putter marker may therefore include a UWB tag and the hole marker may include a UWB anchor, or vice versa. The putt marker preferably includes a display and is configured to display the distance between the putt marker and the hole marker.

With the system 100, a golfer can advantageously move the putt detector 110 (or putt marker) around the putting green/surface and see the displayed distance to the putting hole 140 from any putting location without having to step off or measure the distance. Additionally, there is no need for the golfer to mark the putting location, e.g., with a golf tee, and no need to manually keep track of the number of putts taken and the number of putts made while practicing. The golfer can simply move the putt detector 110 to a desired putting location at a desired distance from the putting hole 140 and start putting balls, with the system 100 automatically tracking putts and makes, preferably over multiple sessions so the golfer can track results. Additionally, the ability to connect, compare results, and compete with friends and other golfers (including by team, school, club, course, etc.) will help gamify putting, with the effect of encouraging players to putt and practice more to increase their putting skills and results.

Depending on how configured for a given implementation, the putt detector 110 and/or the cup detector 120 may also qualify as a smart device, and may therefore host the golf putting app described herein, in addition to or instead of the smart device 150. Further, and as apparent to those skilled in the art, the putt detector 110, the cup detector 120 and the smart device 150 may each include—in addition to the noted displays, modules and sensors—one or more processors, memory, a user input device, and instructions stored in memory that configure the processor(s) to implement and carry out the various functions performed by each device as described herein.

Optionally, the system 100 may include an unmanned aerial vehicle, commonly referred to as a "drone"—in addition to or as part of the putt detector 110, the cup detector 120 or the smart device 150—for performing various functions described herein including detecting when golf balls are putted, detecting when golf balls enter the putting hole and/or determining the distance between the putt detector and the putting hole.

Figure 10:
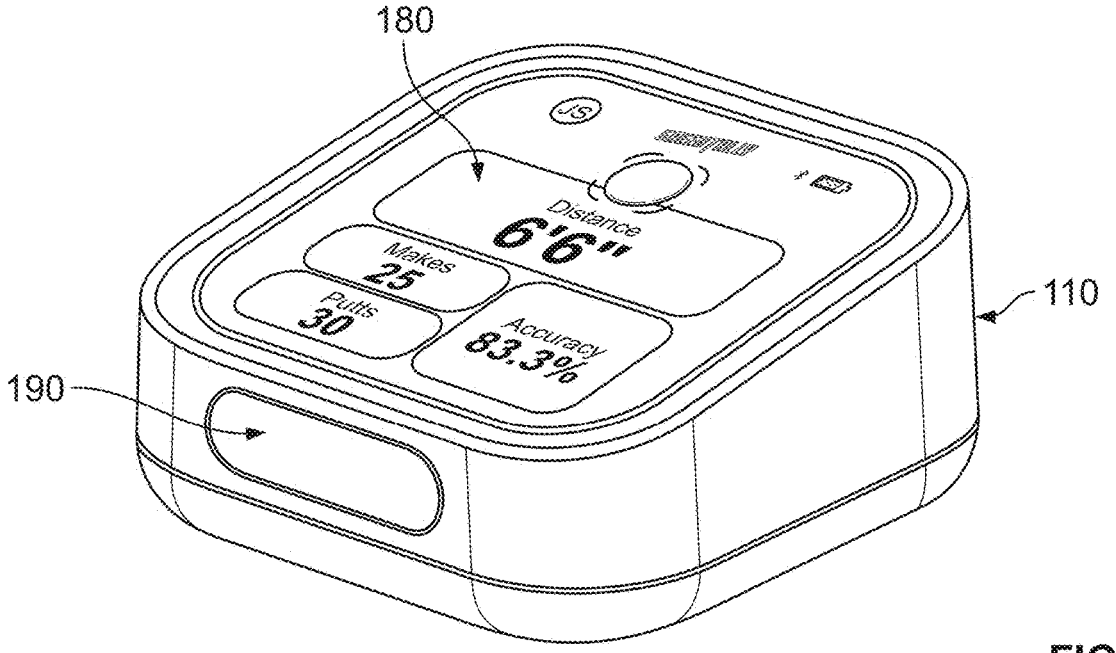
FIG. 10 is a front perspective view of a putt detector according to another example embodiment.
Figure 11:
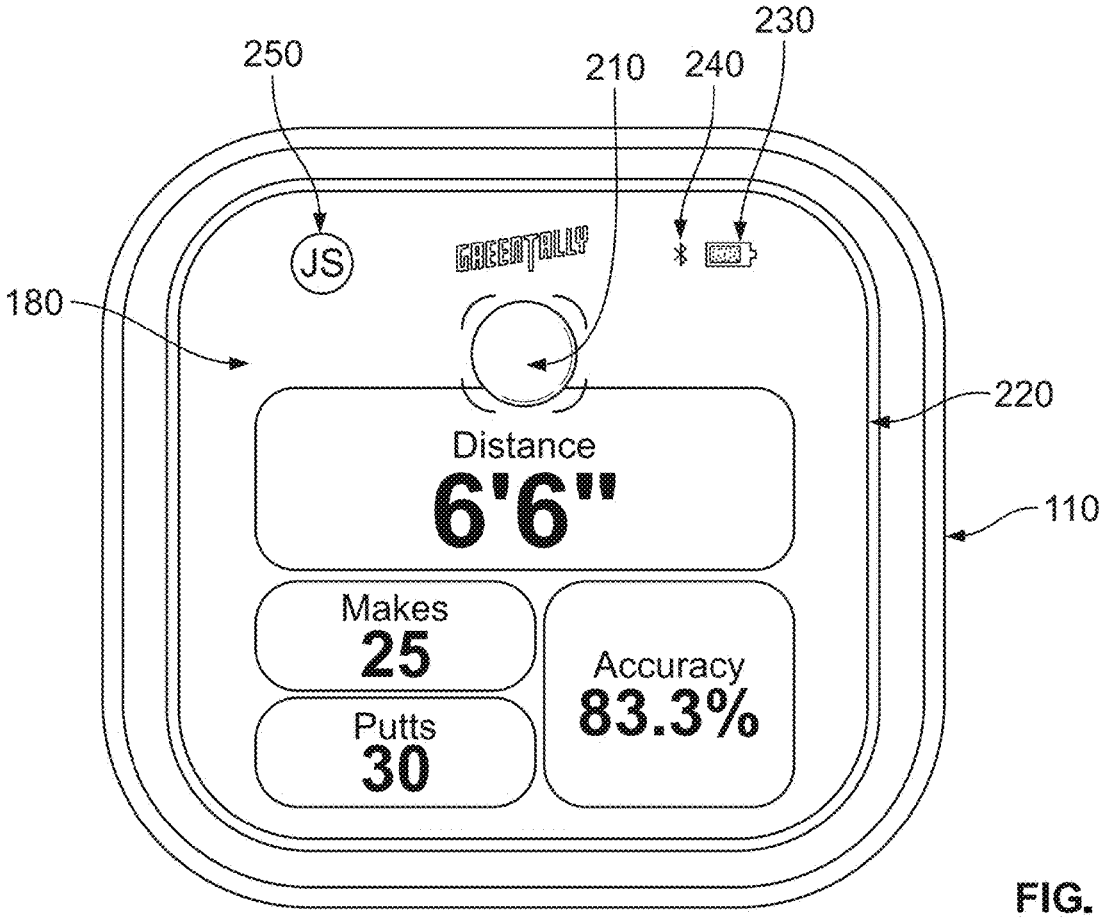
FIG. 11 is a top view of the putt detector shown in FIG. 10.

Another example embodiment of the system 100 will now be described with references to FIGS. 10-35. As shown in FIGS. 10 and 11, the putt detector 110 includes a display 180 on its top surface, which is slightly angled toward its front surface. The putt detector 110 is intended for indoor or outdoor use, with the putt detector 110 resting on the ground (i.e., the putting surface). The display 180 may include a waterproof or water-resistant tempered glass screen. In this particular embodiment, the putt detector 110 includes a radar sensor 190 (e.g., Omnipresence part no. OPS243-C) on or adjacent its front surface to detect when a golf ball is present, to detect when the golf ball is putted and/or to detect the ball speed when putted. Alternatively, the putt detector 110 may employ multiple sensors (e.g., the radar sensor 190 and a 2D camera) to detect when a golf ball is present or putted and/or to detect ball speed. The sensor(s) are preferably located no more than two inches above the putting surface and, more preferably, no more than one inch above the putting surface.

The display 180 includes an indicator 210 (e.g., a golf ball icon) that changes in appearance (i.e., flashes or changes color, brightness, etc.) when the presence of a golf ball (ready to be putted) is detected, or is no longer detected, by the putt detector 110. The display 180 further includes another indicator 220 (e.g., a perimeter light ring) that changes in appearance when the putt detector 110 is wirelessly connecting and/or connected with the smart device 150 (e.g., via Bluetooth). As shown in FIG. 11, the display 180 includes a battery charge indicator 230, a Bluetooth icon 240 indicating when the putt detector 110 is connected to the smart device 150 via Bluetooth, and the putter's initials 250 ("JS" in this example).

The putt detector 110 may display the distance to the hole, the number of putts and makes from that distance during the current putting session, and the putting accuracy (as a percentage), as shown in FIG. 11. Alternatively, the display 180 may be customized by the user via the smart device 150 (or otherwise) to display specific parameters of interest.

Figure 12:
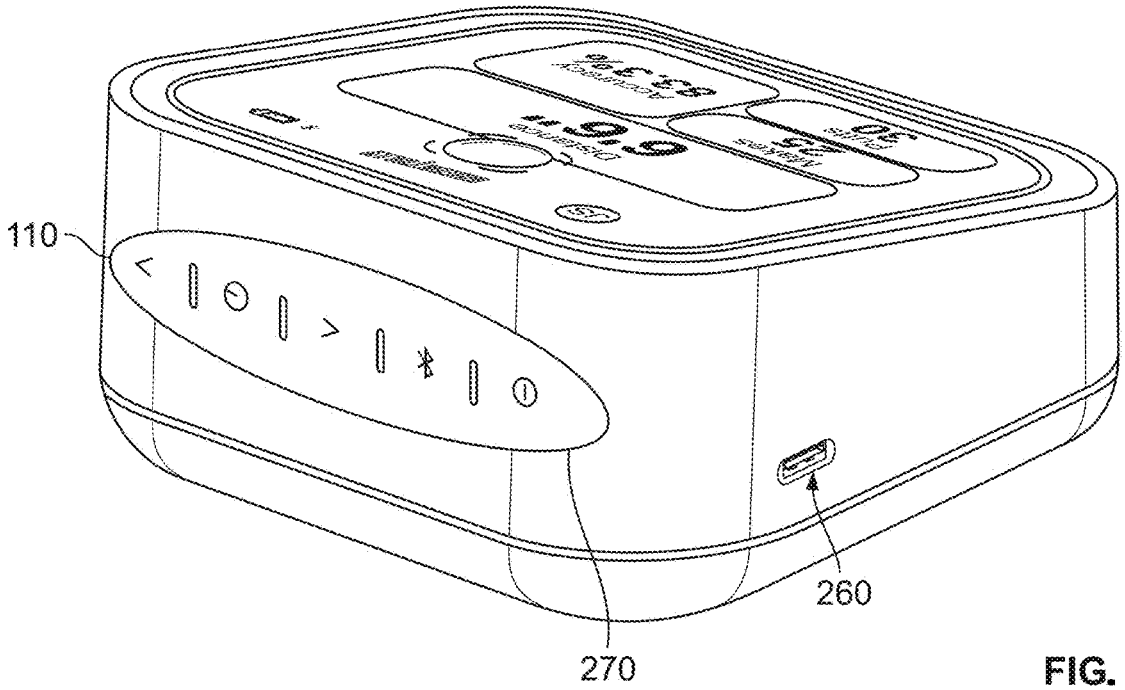
FIG. 12 is a rear perspective view of the putt detector shown in FIG. 10.

As shown in FIG. 12, the putt detector 110 includes a charging port 260 such as a USB-C port on one of its side surfaces. Additionally, the putt detector includes several buttons 270 for power (on/off), Bluetooth, navigate left, navigate right, and select. The buttons 270 are substantially flush with the back surface of the putt detector 110 and are preferably waterproof or water resistant.

Figure 14A:
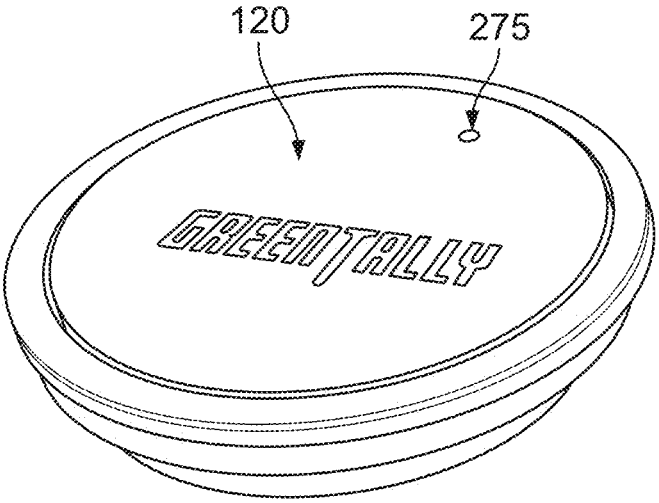
FIG. 14A is a top perspective view of a cup detector according to one example embodiment.
Figure 14B:
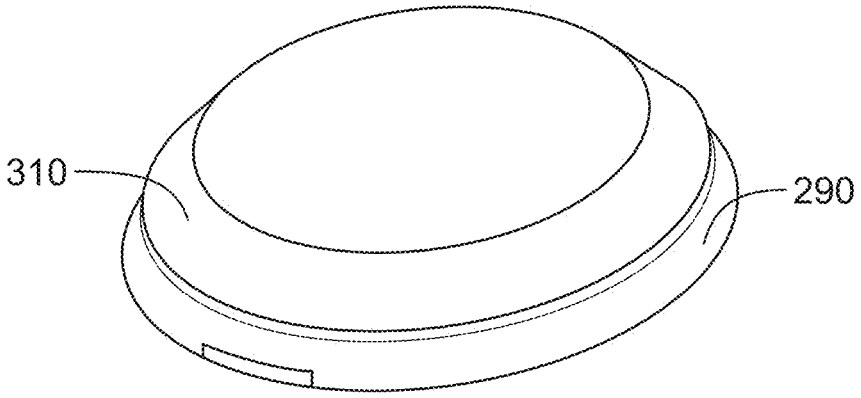
FIG. 14B is a bottom perspective view of the cup detector shown in FIG. 14A.
Figure 15:
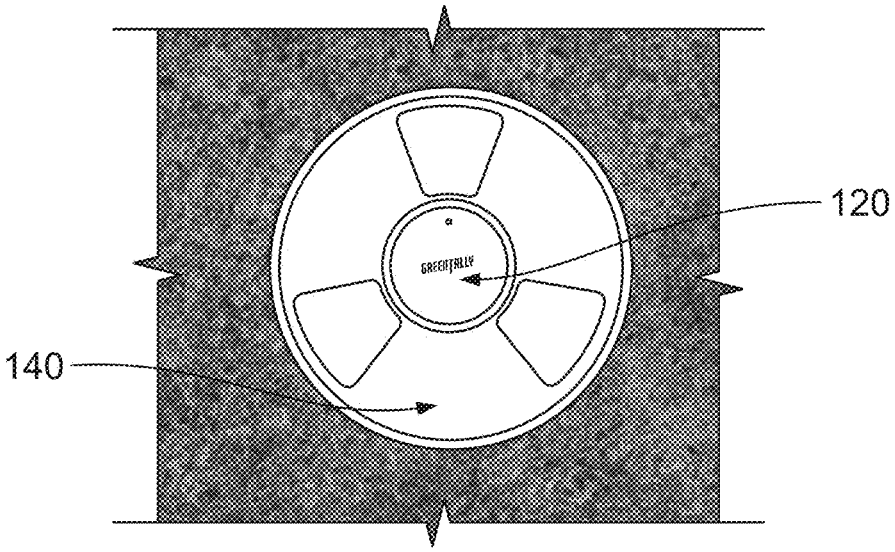
FIG. 15 is a top view of the cup detector shown in FIG. 14A positioned for use in a golf putting hole on a putting green.

In this example embodiment, the cup detector 120 is disc-shaped for placement over and/or mating engagement with the flagstick hole 275 in a conventional putting hole, as shown in FIGS. 14 and 15. The cup detector 120 includes a piezoelectric sensor (e.g., Shutao part no. 13492-1) to detect when golf balls enter the putting hole 140. Alternatively, the cup detector 120 may employ multiple sensors (e.g., the piezoelectric sensor and an accelerometer) to detect when golf balls enter the putting hole. The cup detector 120 is configured to transmit data to the putt detector 110 (e.g. via WiFi and/or Bluetooth) indicating when golf balls enter the putting hole 140. The cup detector 120 includes a power light 275 that changes in appearance (e.g., flashes, changes color or brightness, etc.) when the cup detector 120 is low on battery power.

Figure 13:
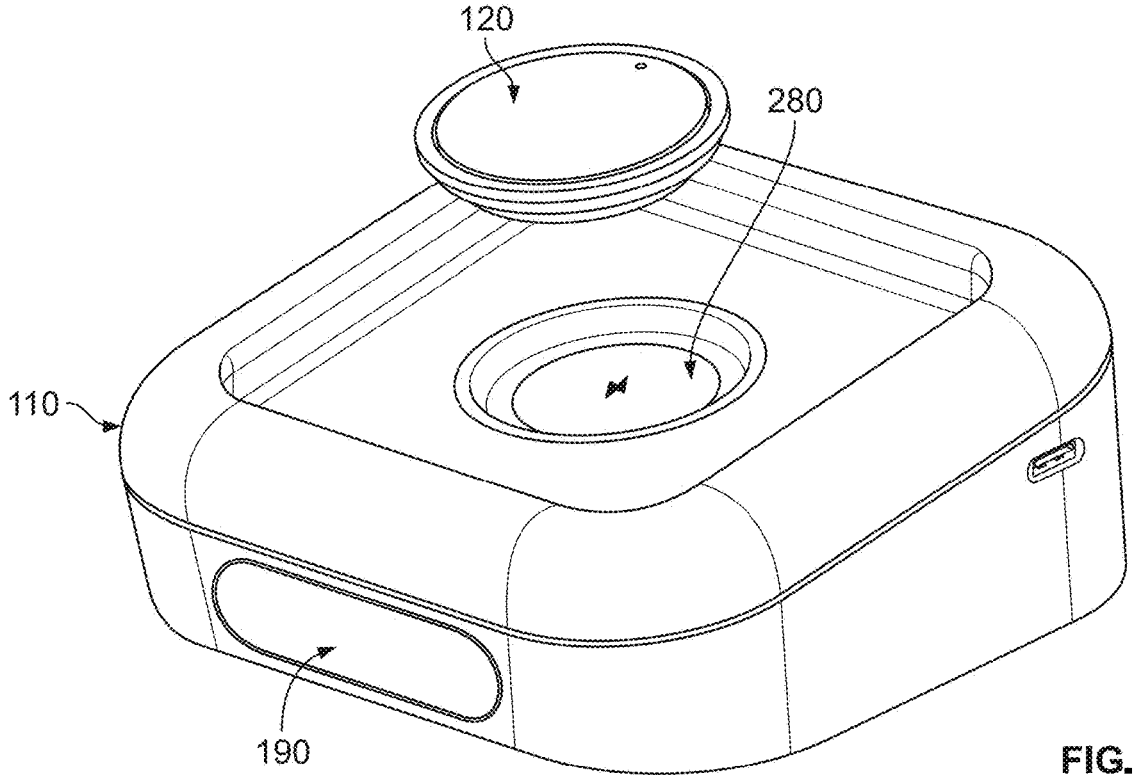
FIG. 13 is a bottom perspective view of the putt detector shown in FIG. 10 and a cup detector that is detachably stowable on the putt detector according to one example embodiment.

Preferably, the cup detector 120 is detachably stowable (e.g., magnetically) on a bottom side of the putt detector 110 when not in use, as shown in FIG. 13. For this purpose, the putt detector 110 includes a magnet 280. Further, the cup detector 120 may be charged wirelessly by the putt detector 110 (e.g., using Crazepony part no. W155801AMBSK281) when stowed.

As shown in FIGS. 14A and 14B, the cup detector 120 includes an upper tapered side portion 290 to facilitate gripping the unit by hand, and a lower tapered side portion 310 that is sized to engage or rest over the flagstick hole 275 of a conventional putting hole. For this purpose, the bottom edge of the lower tapered side portion 310 preferably has a smaller diameter than the diameter of a conventional flagstick hole 275. The top edge of the lower tapered side portion 310 preferably has a greater diameter than a conventional flagstick hole 275. The diameter of a conventional flagstick hole 275 is no more than 0.75 inches. At least the bottom surface and the lower tapered side portion 310 of the cup detector 120 may be covered by or incorporate a vibration damping material such as rubber.

The putt detector 110 is configured to determine the distance between the putt detector 110 and the cup detector 120 using ultra-wideband (UWB) positioning (e.g., using a Challenger RP2040 UWB board). Accordingly, the putt detector 110 may include a UWB tag and the cup detector 120 may include a UWB anchor, or vice versa. Additionally, the putt detector 110 is preferably configured to use the detected ball speed when putted, and the determined distance between the putt detector 110 and the putting hole 140, to calculate the ball's arrival time at the hole. Further, the putt detector 110 may be configured to use the calculated arrival time to determine whether a putt was made (e.g. based on whether the cup detector 120 detects a golf ball entering the putting hole at the calculated arrival time plus or minus some margin for error or variations, such as one, two, three or four seconds, etc.).

The putt detector 110 is also configured to transfer the detected and generated putting information to the smart device 150, and to retrieve putting information from the smart device 150 (e.g., using an application program stored on the smart device 150) for displaying on the display 180.

Figure 16:
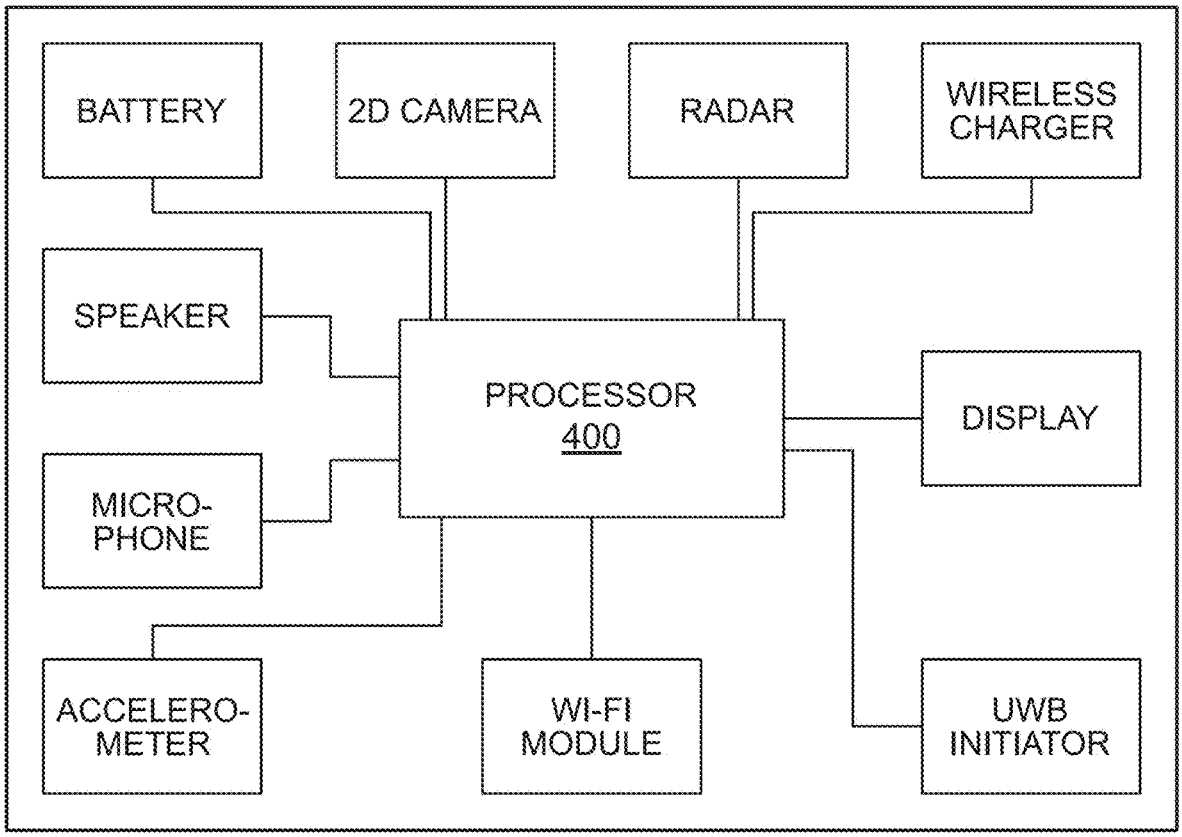
FIG. 16 is a block diagram of a putt detector according to one example embodiment of the present disclosure.

As shown in FIG. 16, an example control circuit for the putt detector 110 may include a processor 400 (e.g., an Epressif ESP32 hybrid Wi-Fi & Bluetooth chip) coupled to a 2D camera, radar sensor, wireless charger (for charging the cup detector 120 when stowed), LCD display, lithium ion battery, speaker, microphone, accelerometer, Wi-Fi module and UWB initiator. In the embodiment of FIG. 16, the processor 400 uses data from both the radar sensor and the 2D camera to detect the presence of a golf ball and when the golf ball is putted. Alternatively, the processor 400 may be configured to detect the presence and putting of golf balls using the microphone in addition to, or instead of, the 2D camera and/or radar sensor.

The processor 400 is configured to communicate with the cup detector 120 using the Wi-Fi module (e.g., via the ESP-NOW protocol) to receive vibration and/or other data from the cup detector 120 indicating when golf balls enter the putting hole. Additionally, the processor 400 may be configured to provide user feedback (e.g., beeps, chirps, voice commands, etc.) via the speaker. Further, the processor 400 may be configured to use the microphone and/or speaker to support voice or video communications between the user of the putt detector 110 and other individuals including, for example, individuals in other locations that are participating in a putting competition with the user of the putt detector 110.

The processor 400 employs the UWB initiator to send a UWB signal to and receive a UWB response from the cup detector 120 to determine the distance between the putt detector 110 and the cup detector 120. Further, the processor 400 uses the accelerometer to detect whether the putt detector 110 is moving or stationary. Preferably, the processor 400 is configured (i.e., via computer instructions stored in memory) to automatically determine the distance between the putt detector 110 and the cup detector 120 only after the putt detector 110 is moved and becomes stationary again. Further, once the determined distance to the hole is displayed, the processor 400 is preferably configured to not change the displayed distance before the putt detector 110 is moved again. While only one processor 400 is shown in FIG. 16, it should be understood that multiple processors may be employed in any given implantation of the putt detector 110.

Figure 17:
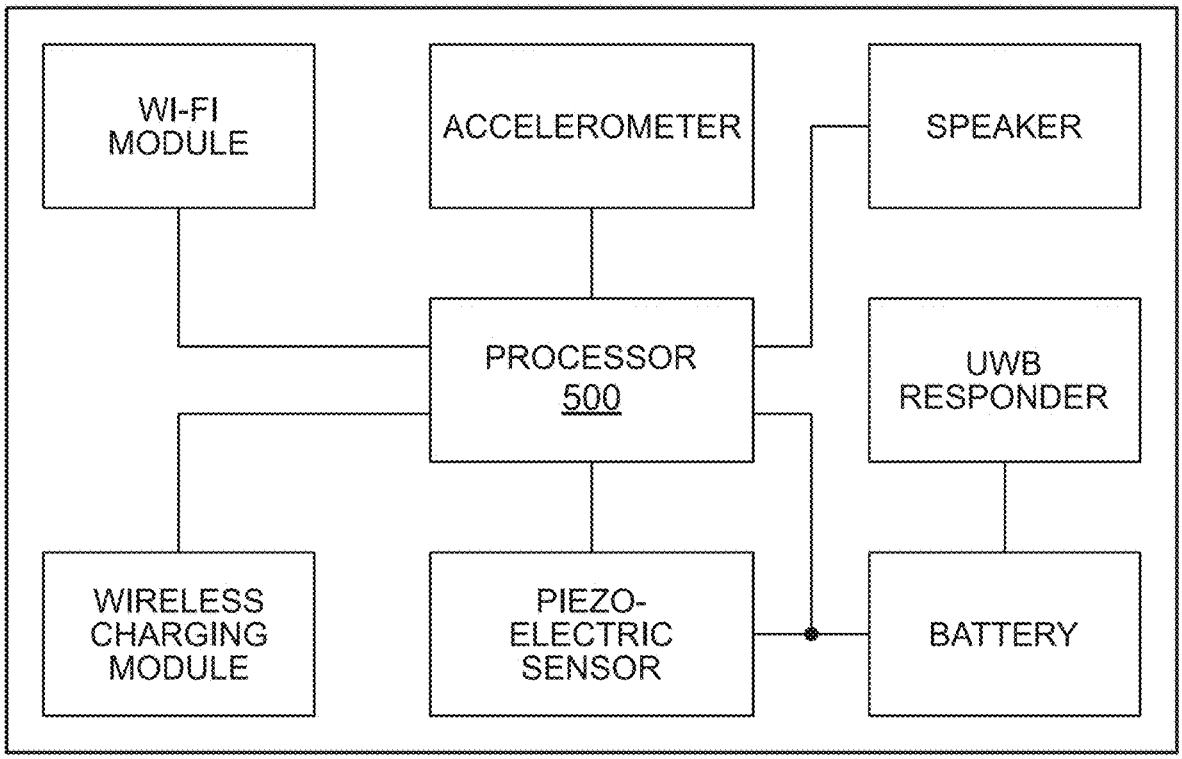
FIG. 17 is a block diagram of a cup detector according to another example embodiment of the present disclosure.

As shown in FIG. 17, an example control circuit for the cup detector 120 may include a processor 500 (e.g., an Epressif ESP32 hybrid Wi-Fi & Bluetooth chip) coupled to a Wi-Fi module, piezoelectric sensor, accelerometer, speaker, UWB responder, lithium ion battery, and wireless charging module (for charging the cup detector 120 when stowed on the putt detector 110). In the embodiment of FIG. 17, the processor 500 uses signals from both the piezoelectric sensor and the accelerometer to detect when golf balls enter the putting hole. The processor 500 may employ the speaker for providing chirps or other user feedback.

Figure 18:
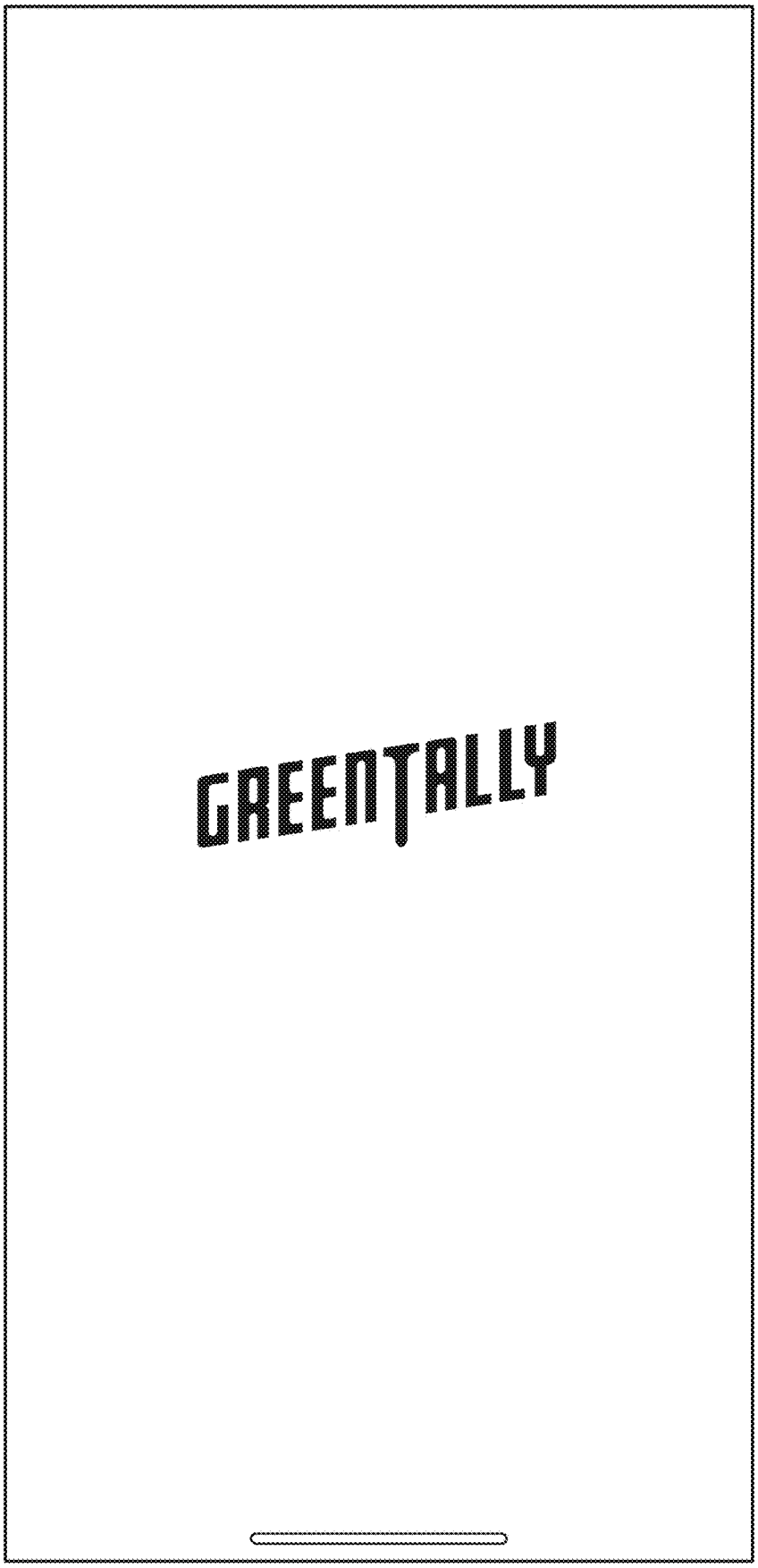
FIGS. 18-37 illustrate the user interface of a smart device application for receiving, processing and storing golf putting information.
Figure 19:
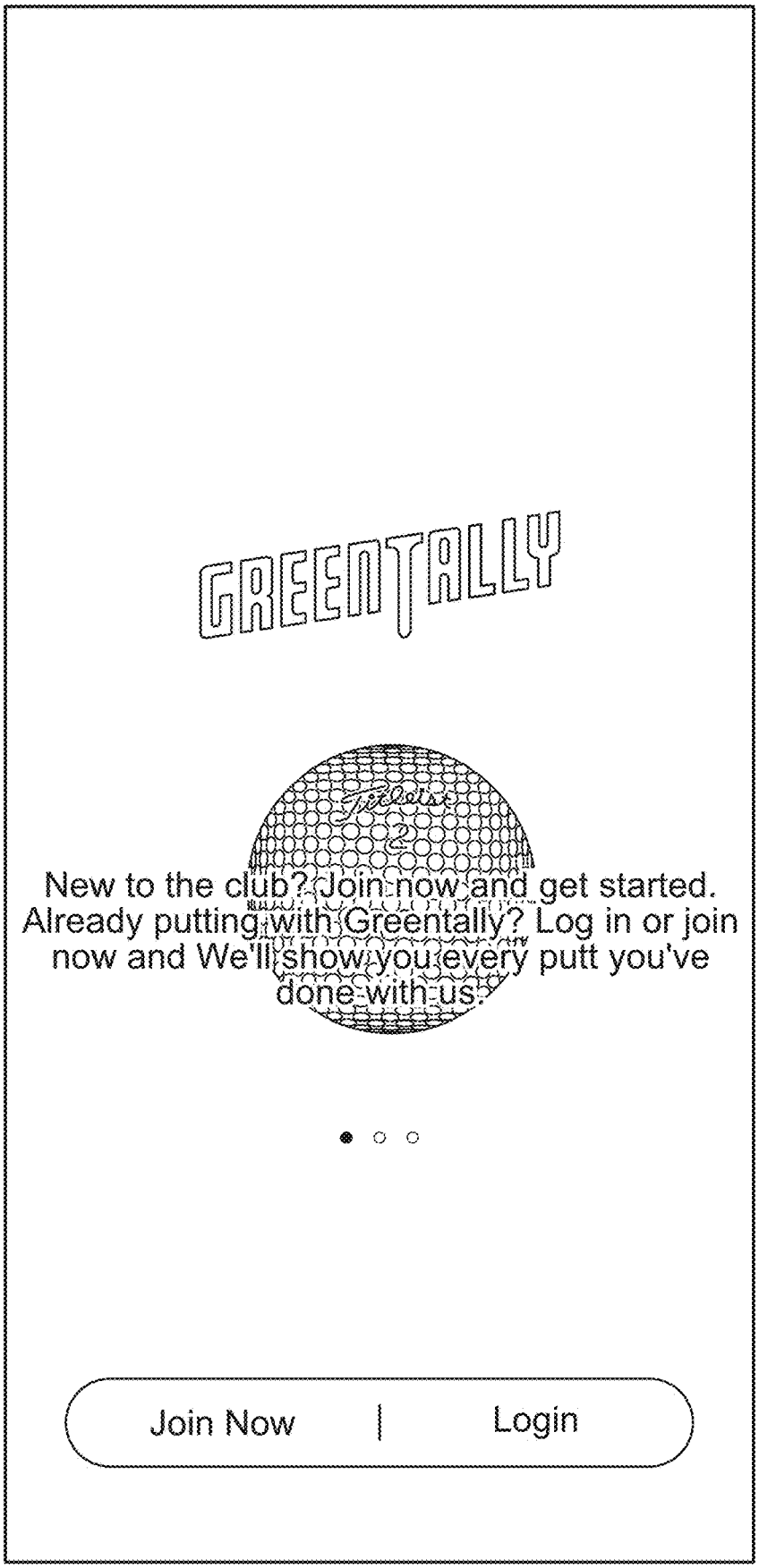
Figure 20:
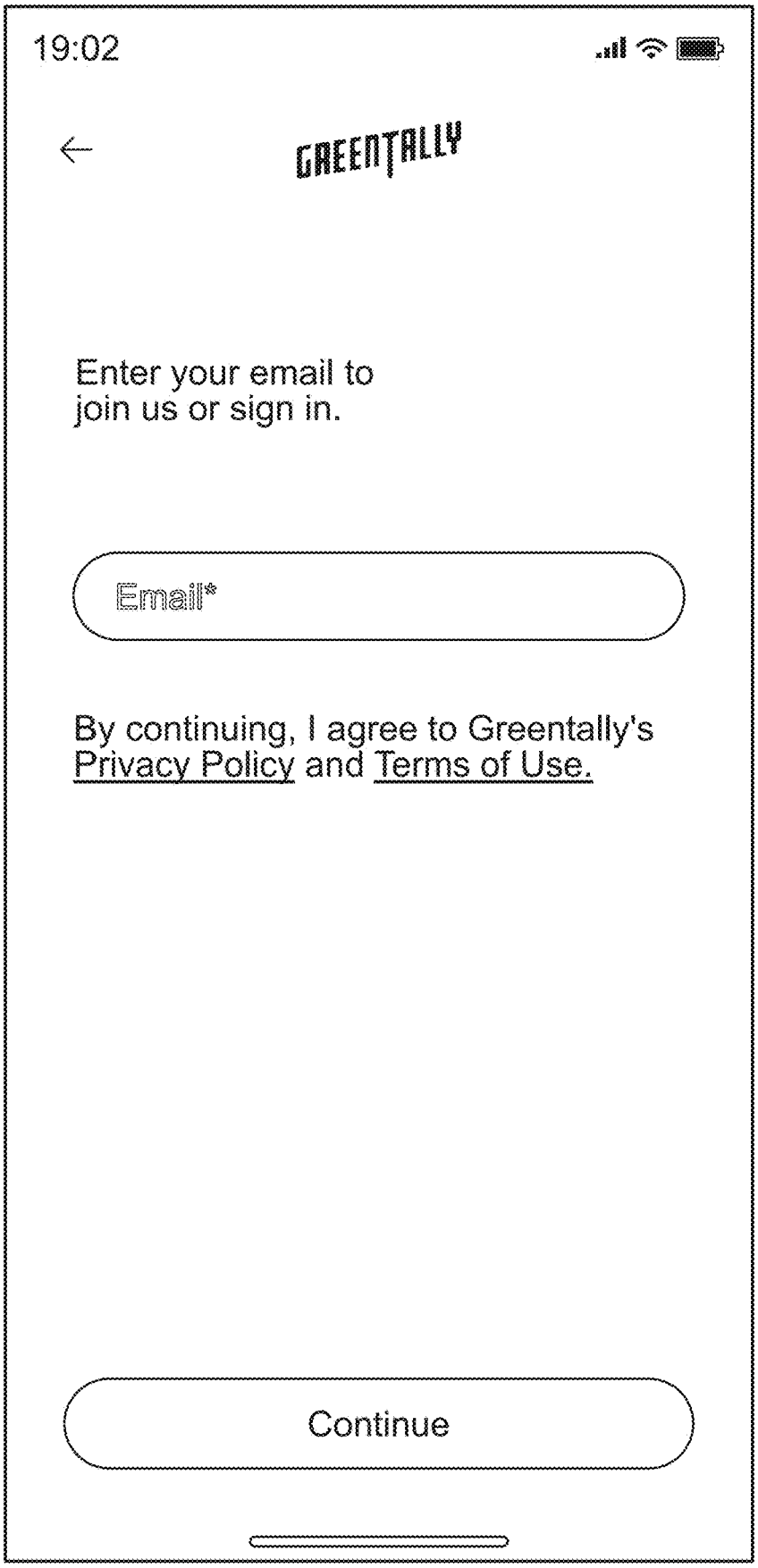
Figure 21:
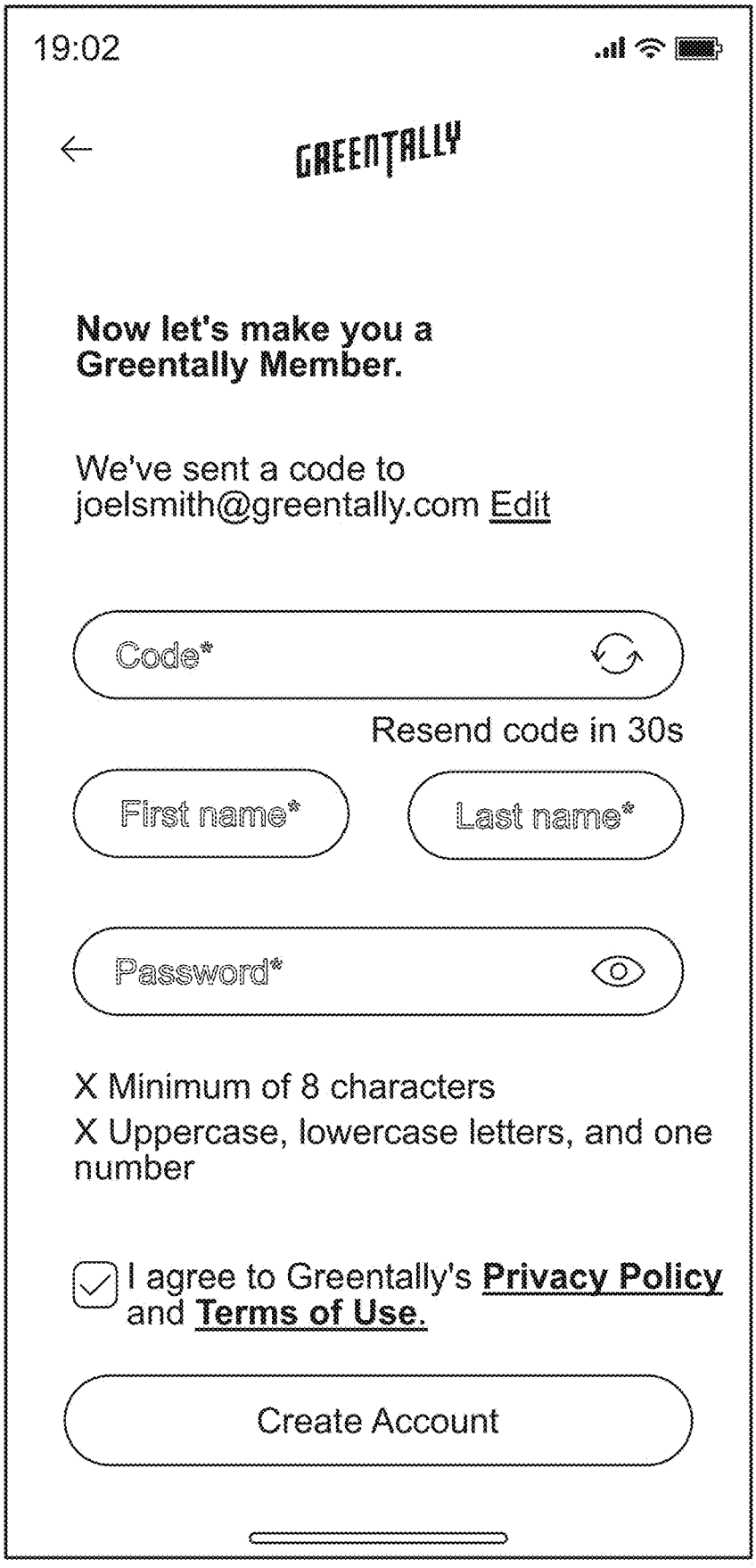
Figure 22:
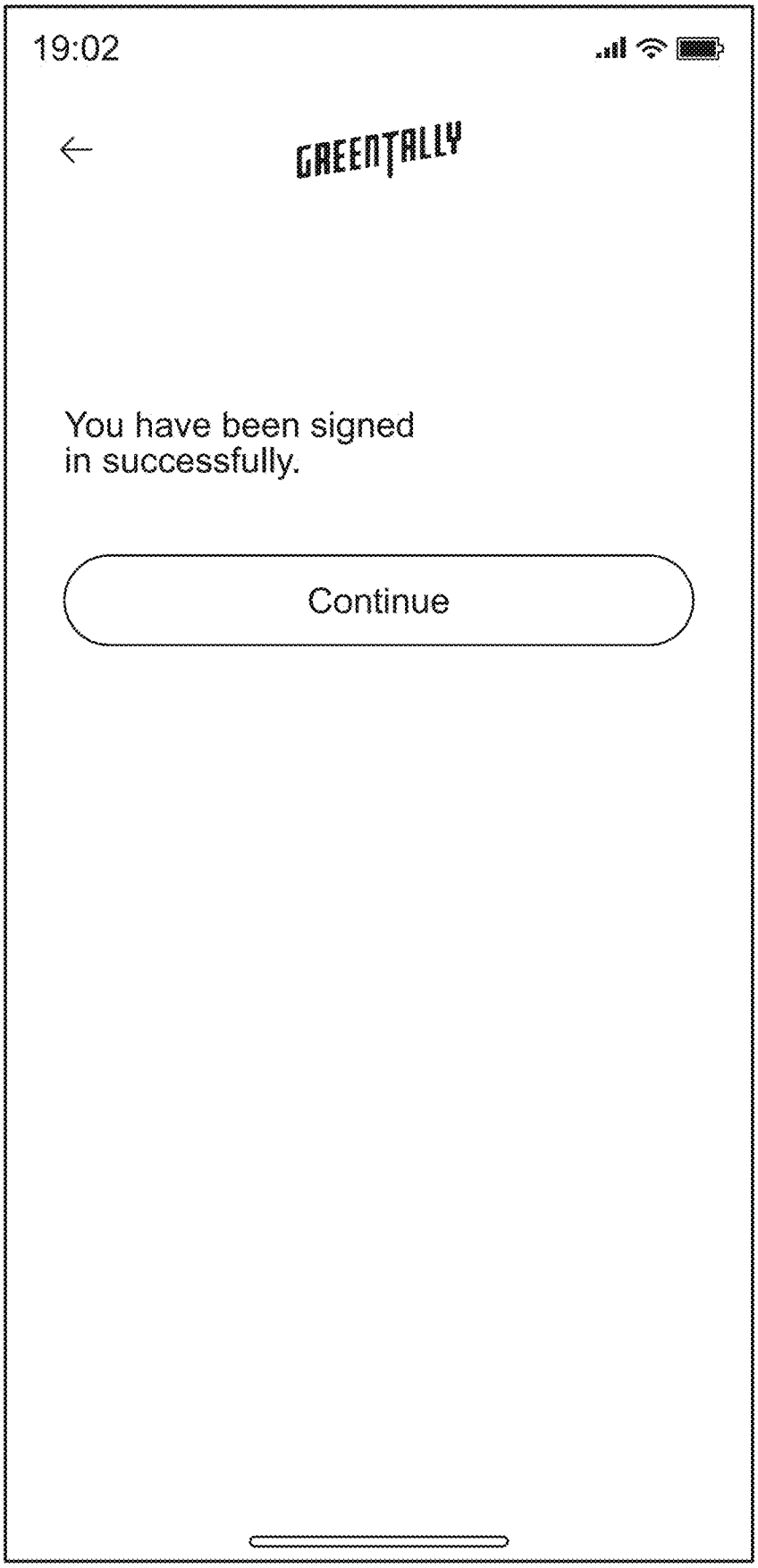
Figure 23:
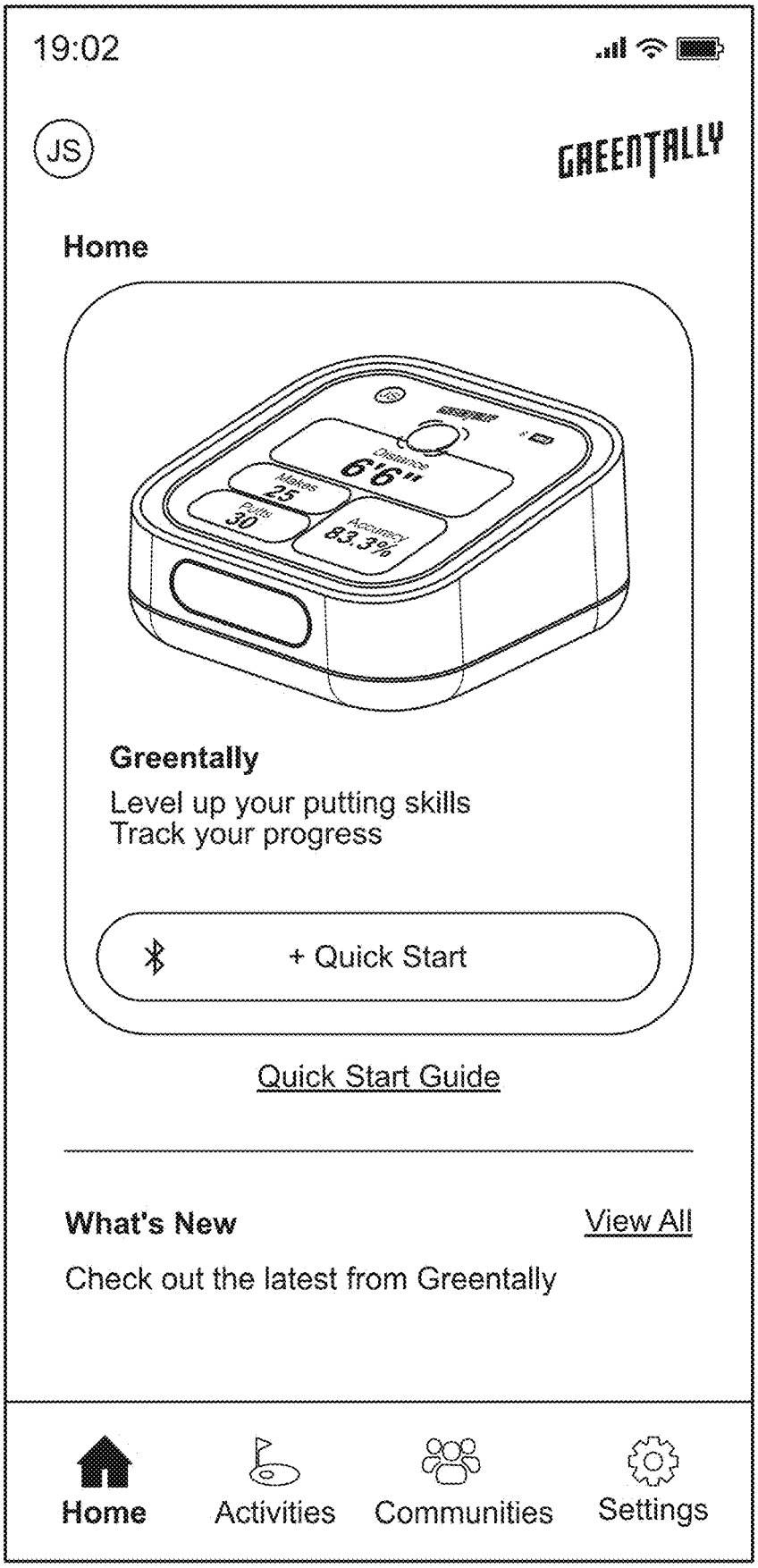
Figure 24:
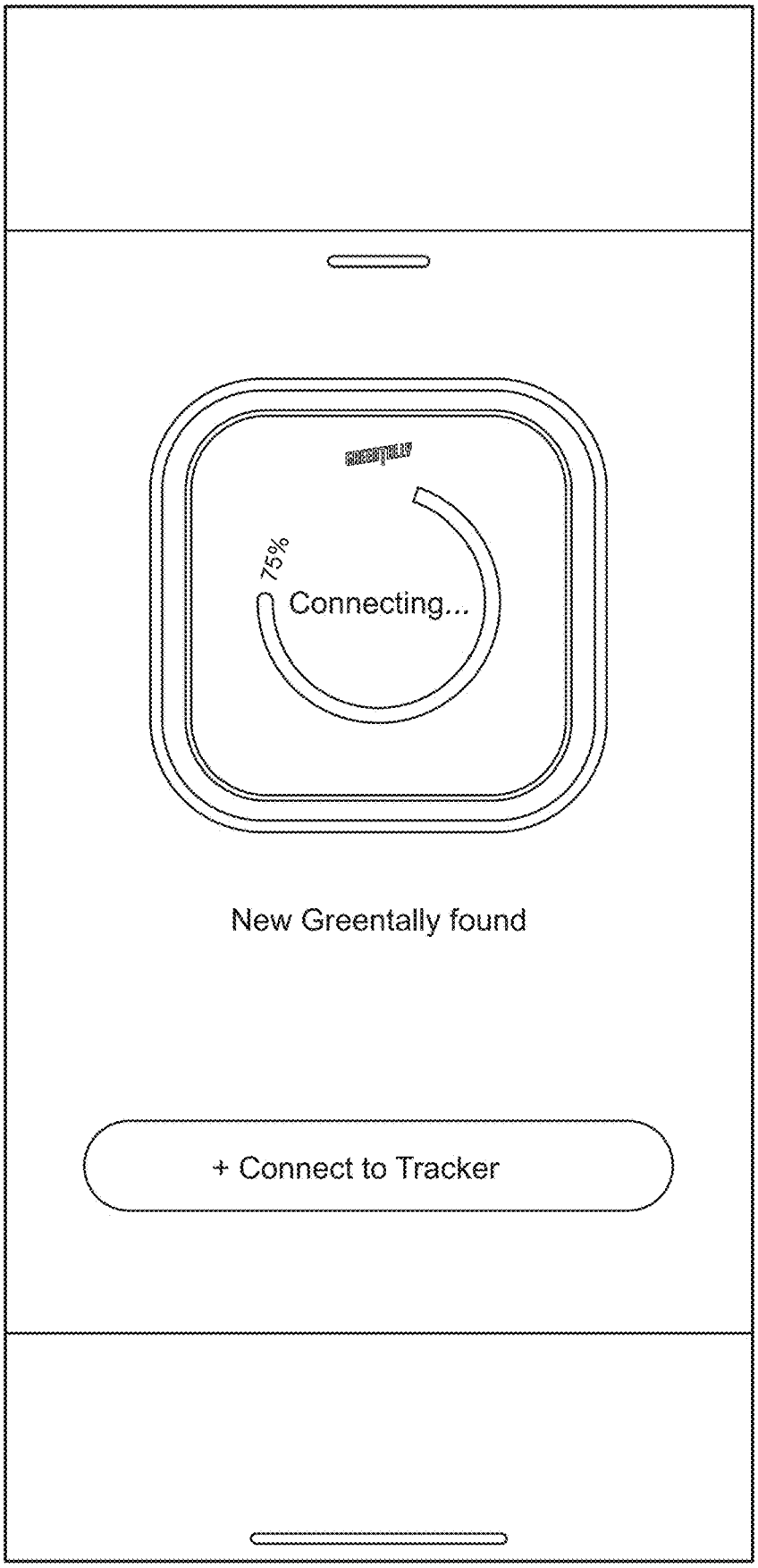
Figure 25:
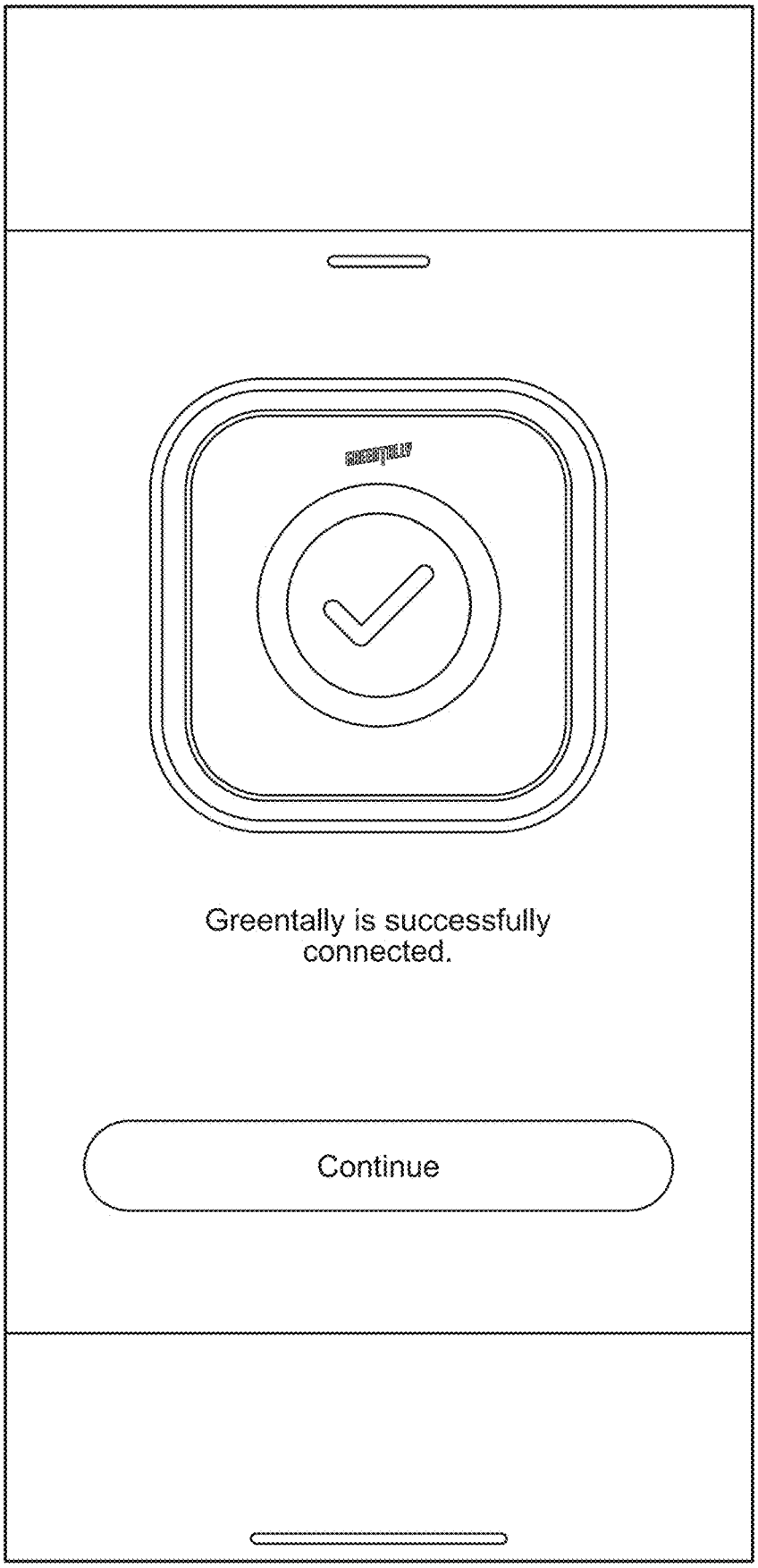
Figure 26:
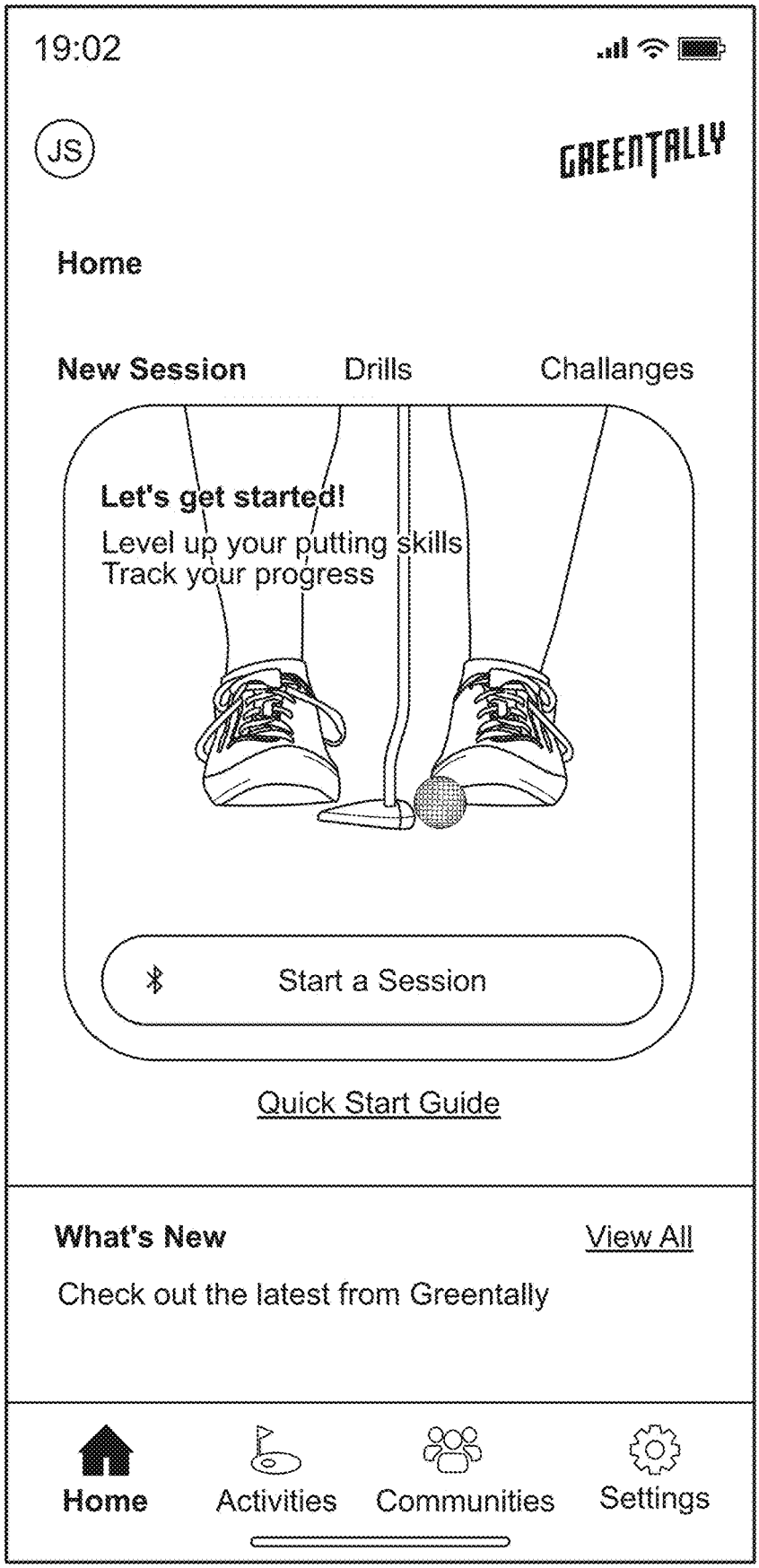

One example embodiment of a software application (a/k/a "app") for the smart device 150 will now be described with reference to FIGS. 18-37. In this particular embodiment, the app is intended to provide access to a repository of information for individual players as well as larger groups, teams and organizations. The information may include statistics which may be broken down by session results, putting drill results, public and private leaderboards, general statistics, etc. FIG. 18 illustrates the loading screen for the app. FIG. 19 illustrates the login or register screen. If the user selects "Join Now," they will proceed to the screens shown in FIGS. 20 and 21 to enter their email address, name, password, etc. to create a new account. If the user signs in successfully, the app displays the screen shown in FIG. 22. FIG. 23 illustrates the "Quick Start" screen for pairing the putt detector 110 to the smart device 150. When the app detects the putt detector 110, it displays the screen shown in FIG. 24. The user can then select "Connect to Tracker." When the putt detector 110 is successfully connected to the app, the app will display the screen shown in FIG. 25. The user can then select "continue" to proceed to a home page, as shown in FIG. 26.

Figure 27:
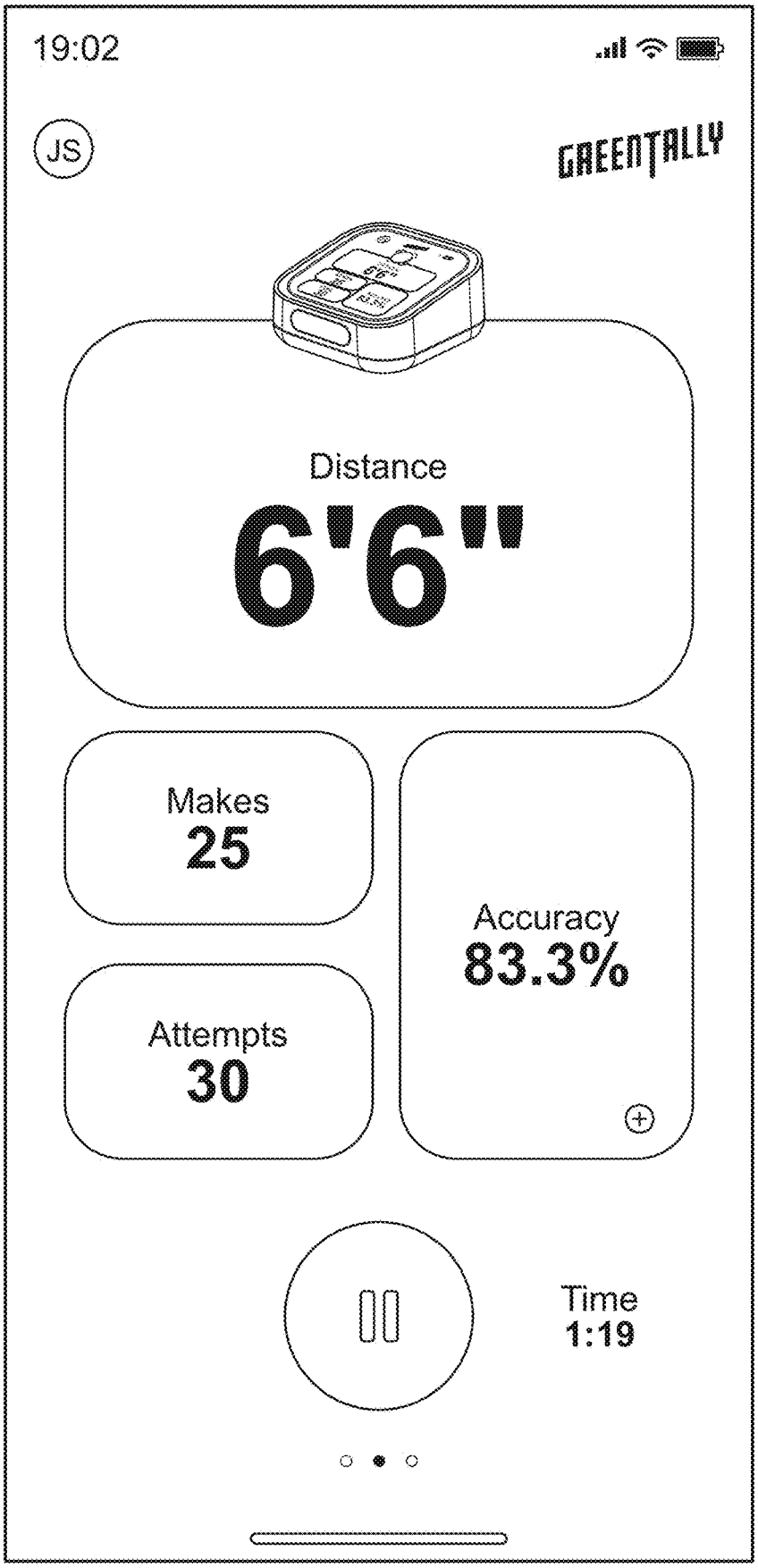
Figure 28:
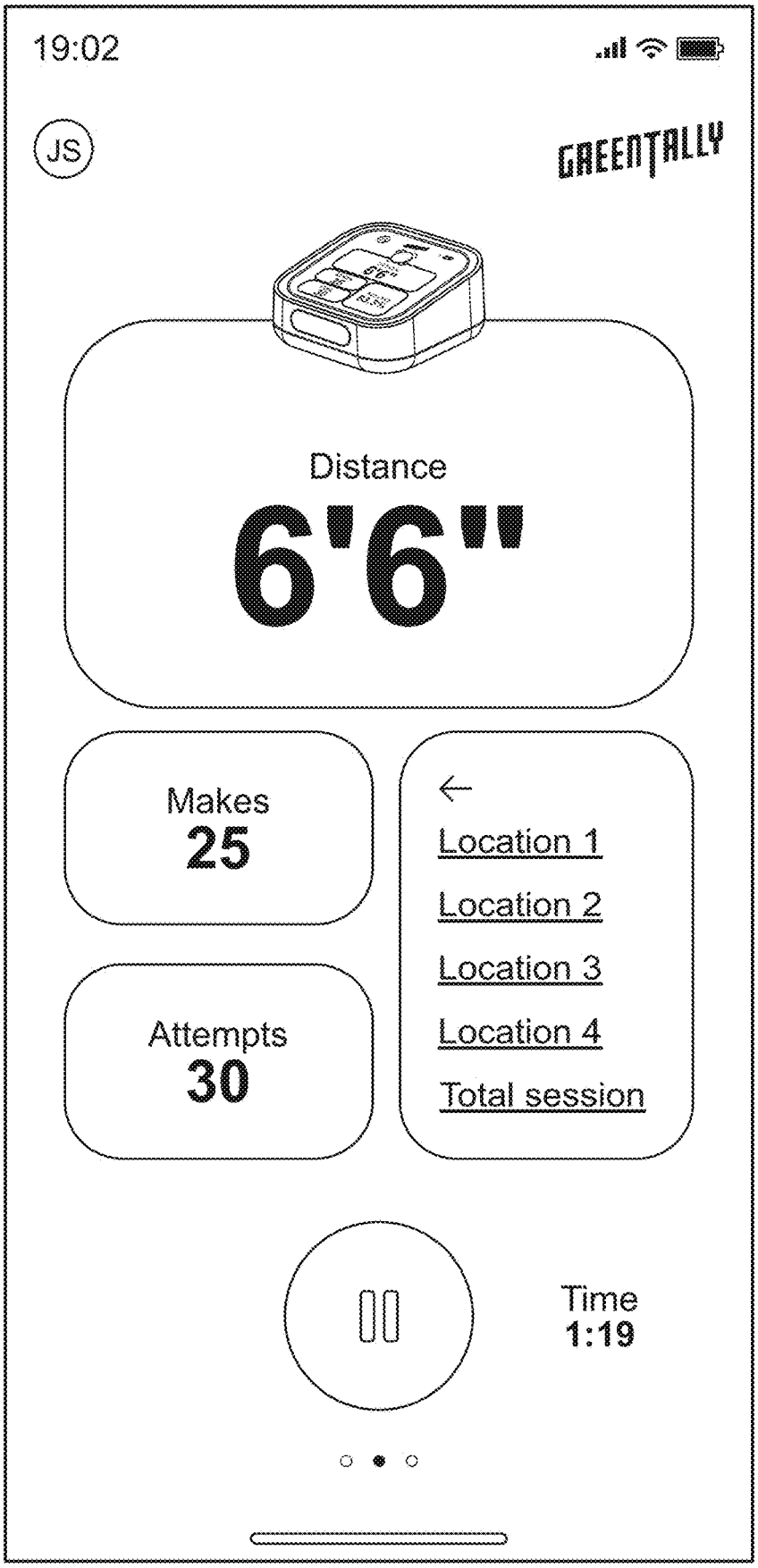

The user can begin a live putting session by selecting "Start a Session." In response, the app will display the screen shown in FIG. 27, which provides the distance to the hole, the putts and makes at that distance (since last reset), accuracy at that distance (since last reset), and the current session time. The user can also enter or select his or her current location and track putting results by location, as shown in FIG. 28.

Figure 29:
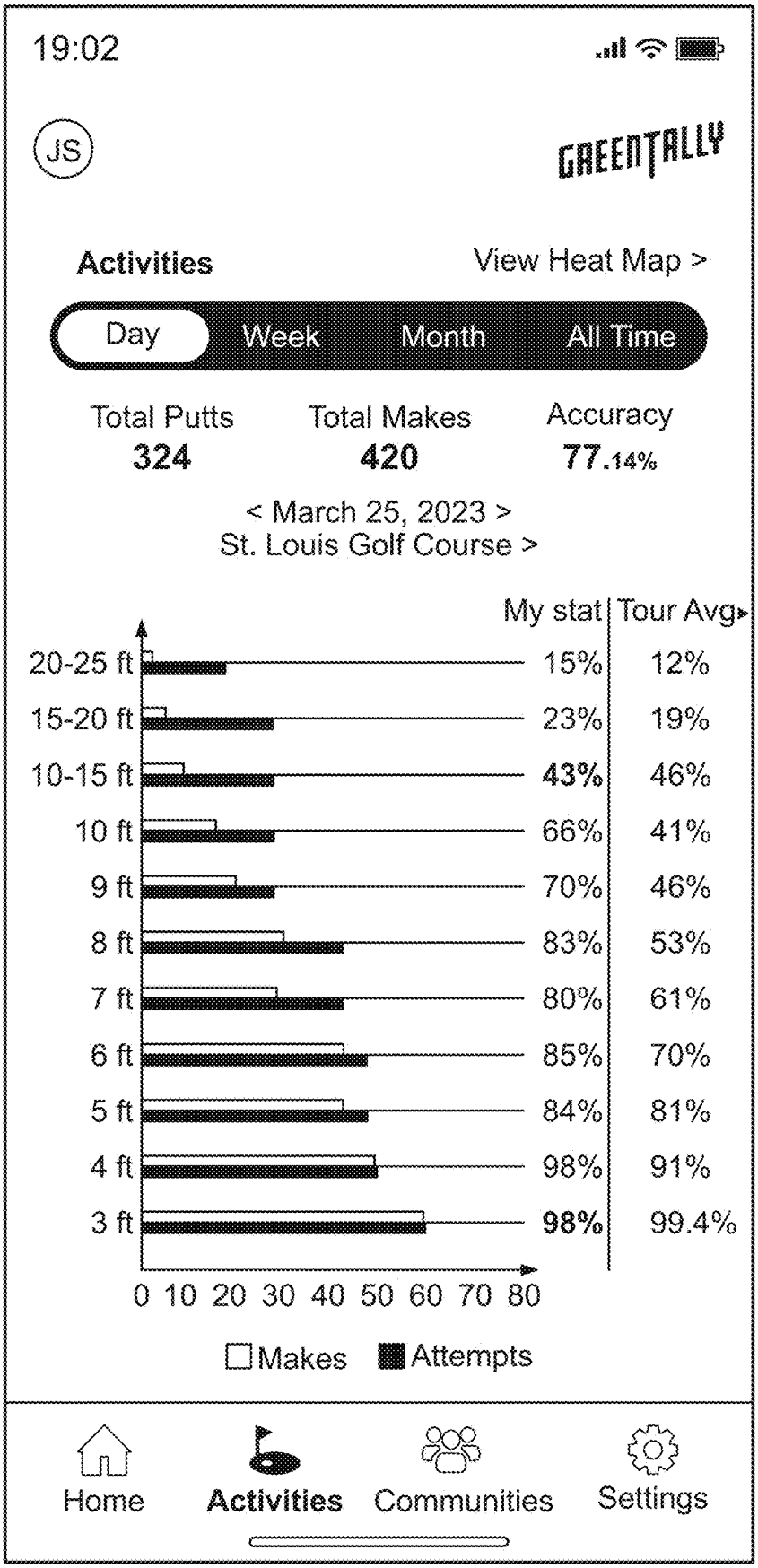
Figure 30:
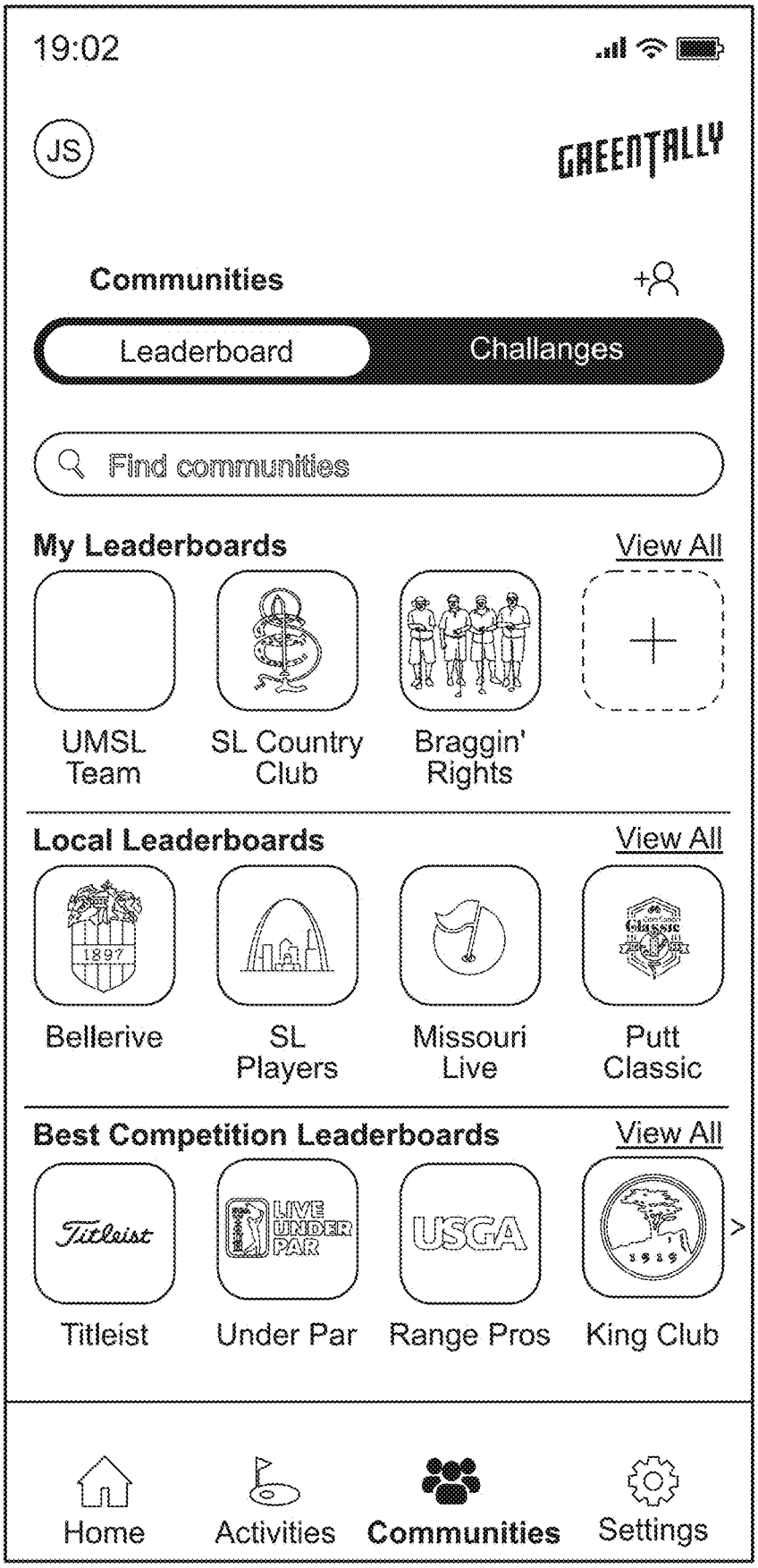
Figure 31:
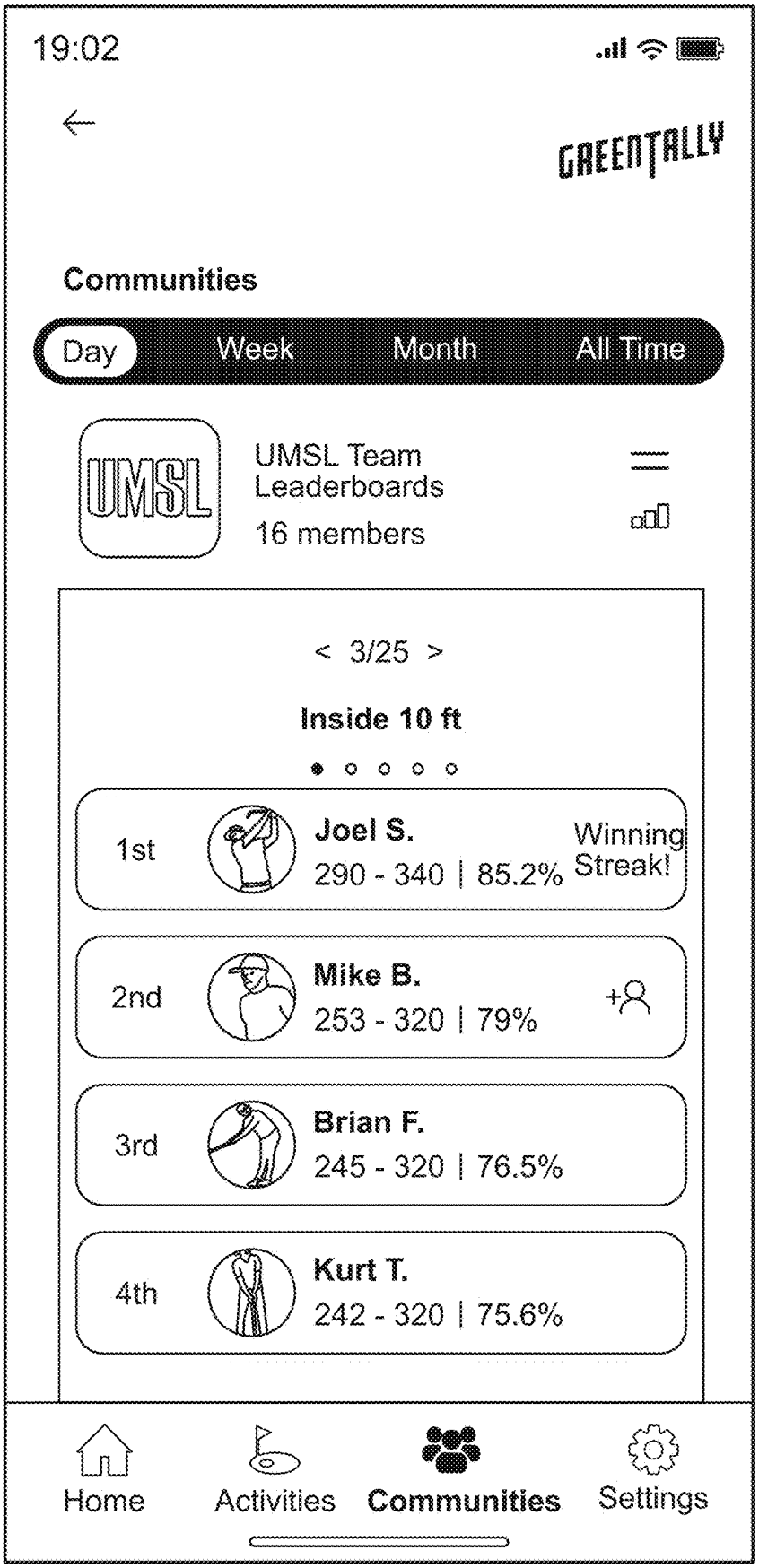
Figure 32:
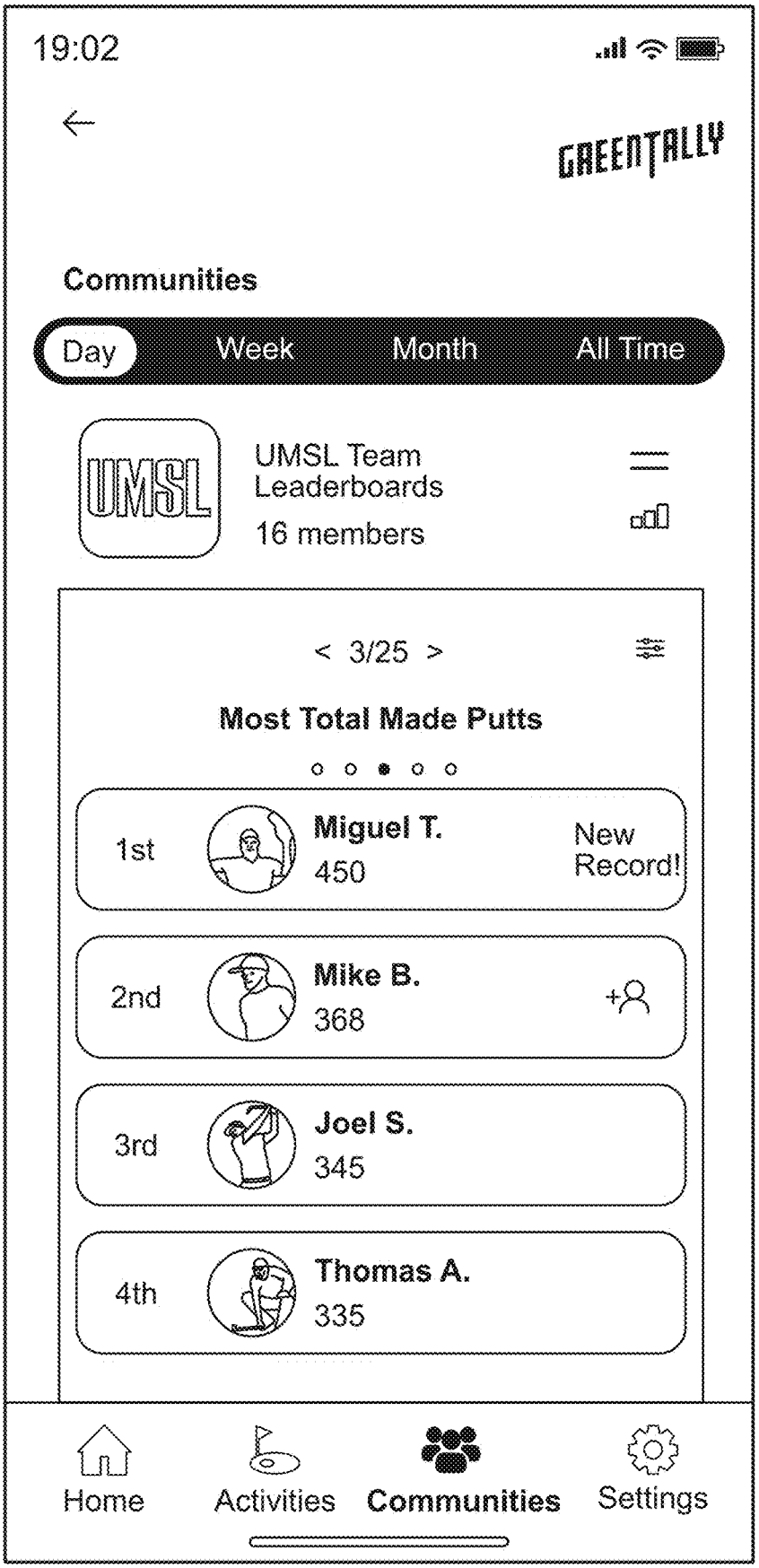
Figure 33:
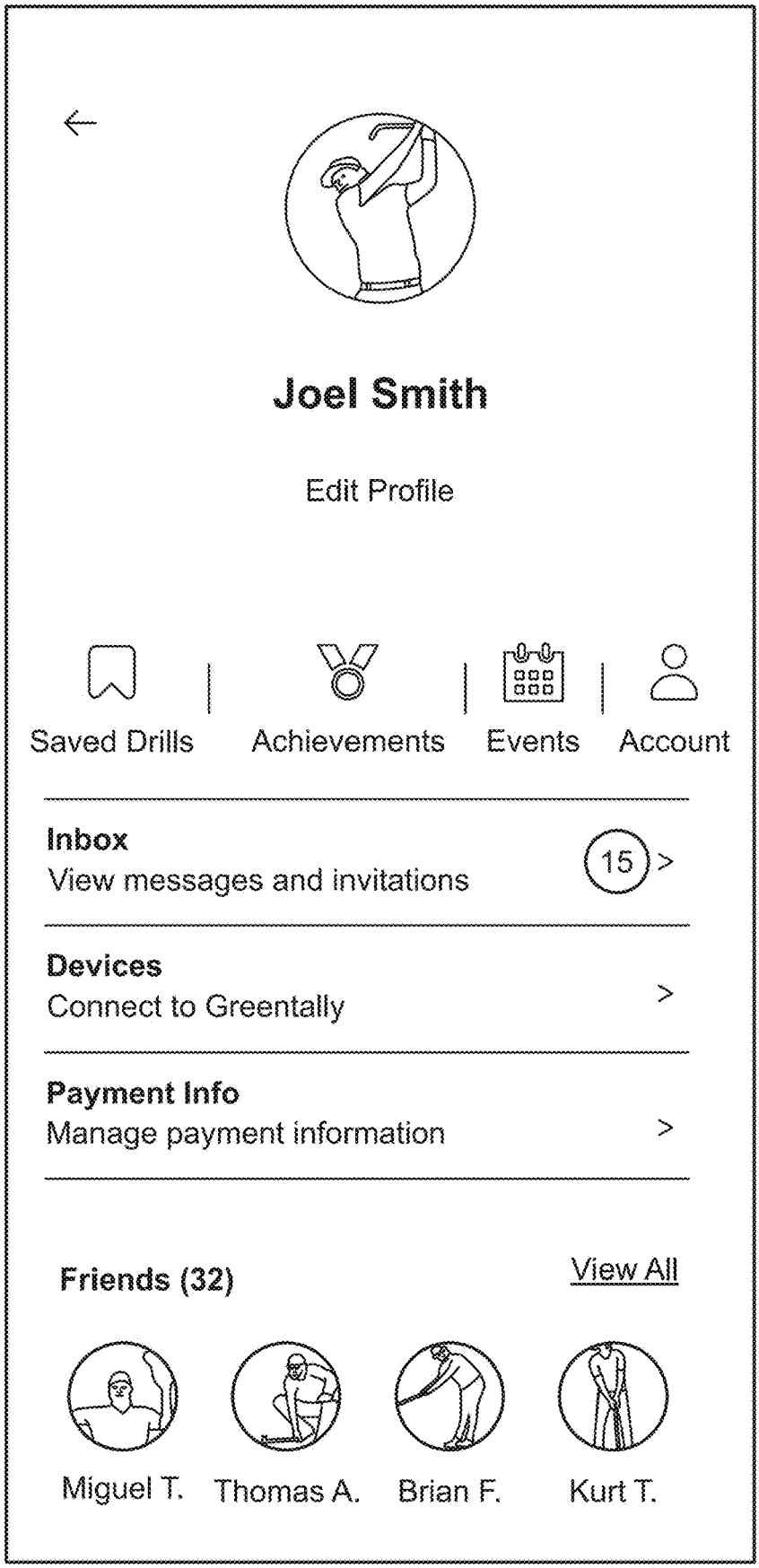
Figure 34:
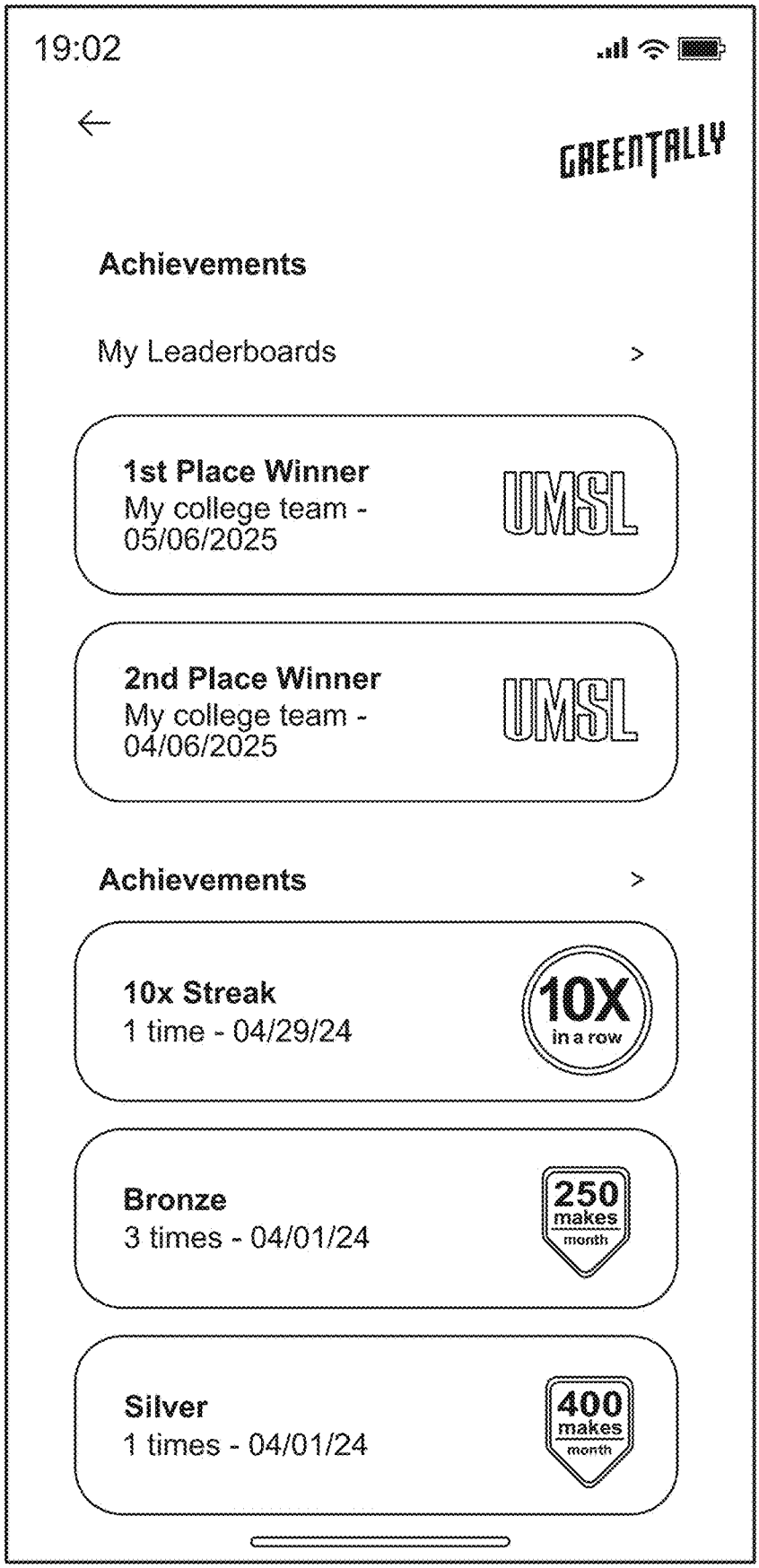
Figure 35:
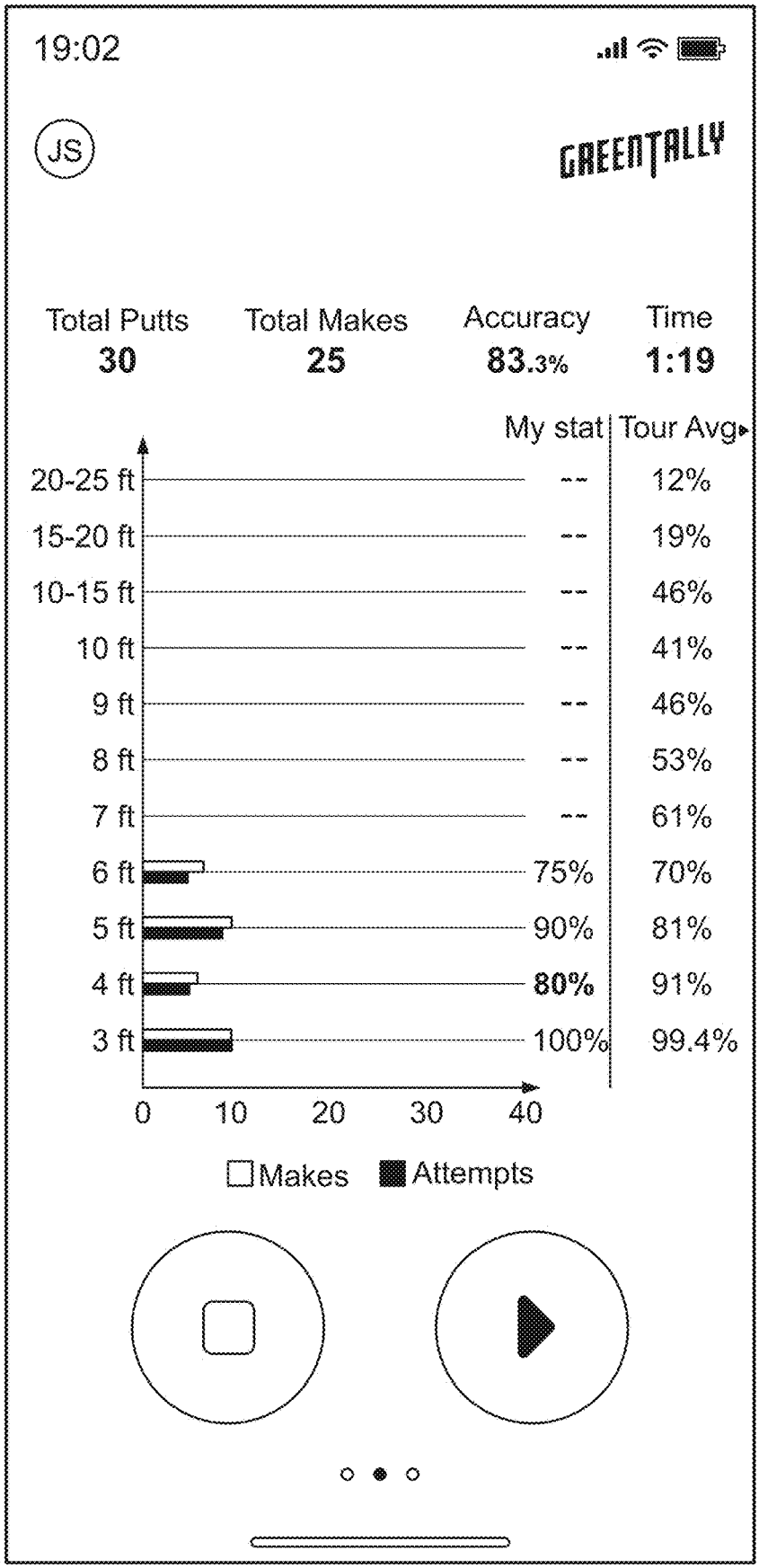
Figure 36:
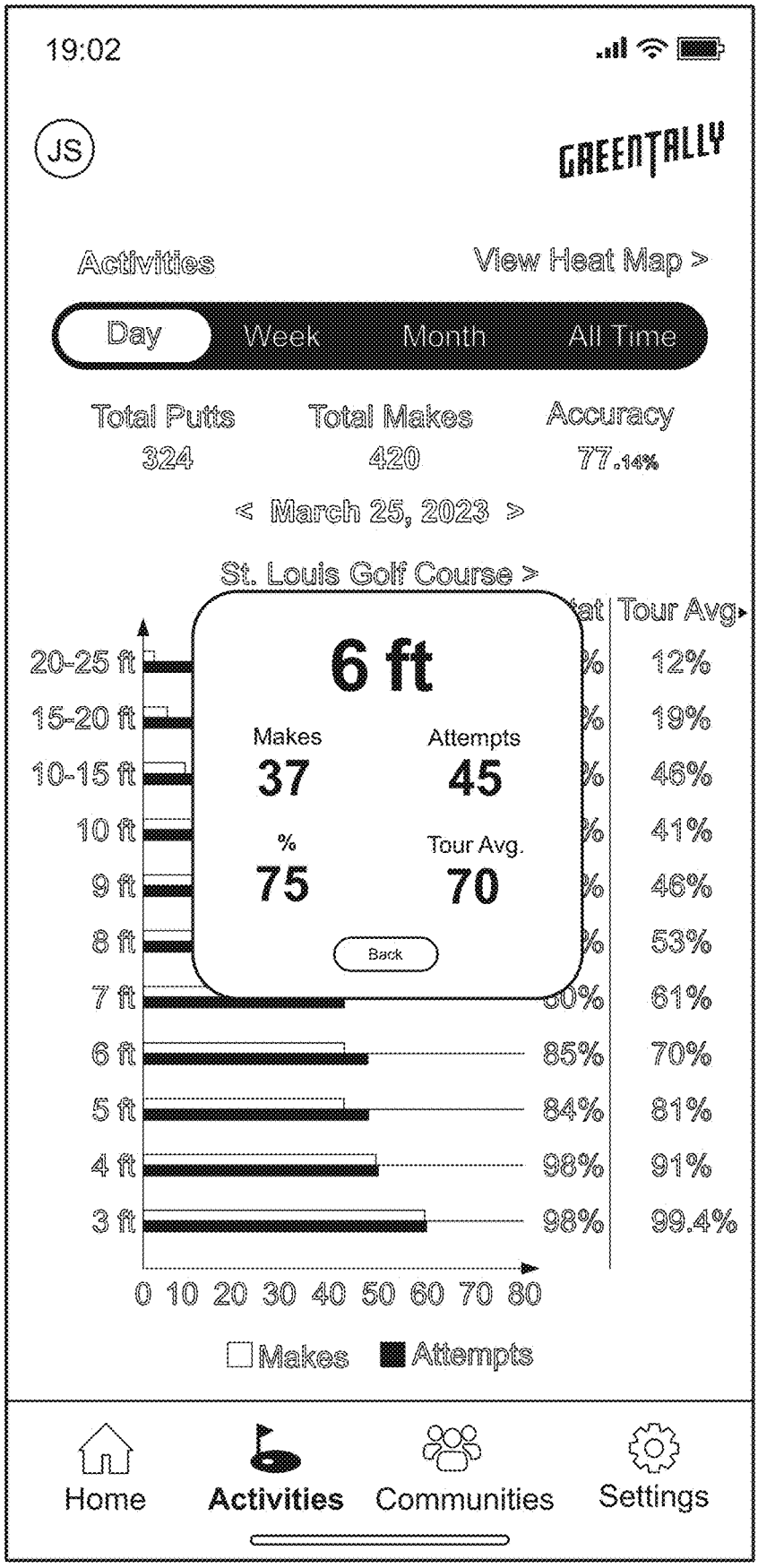
Figure 37:
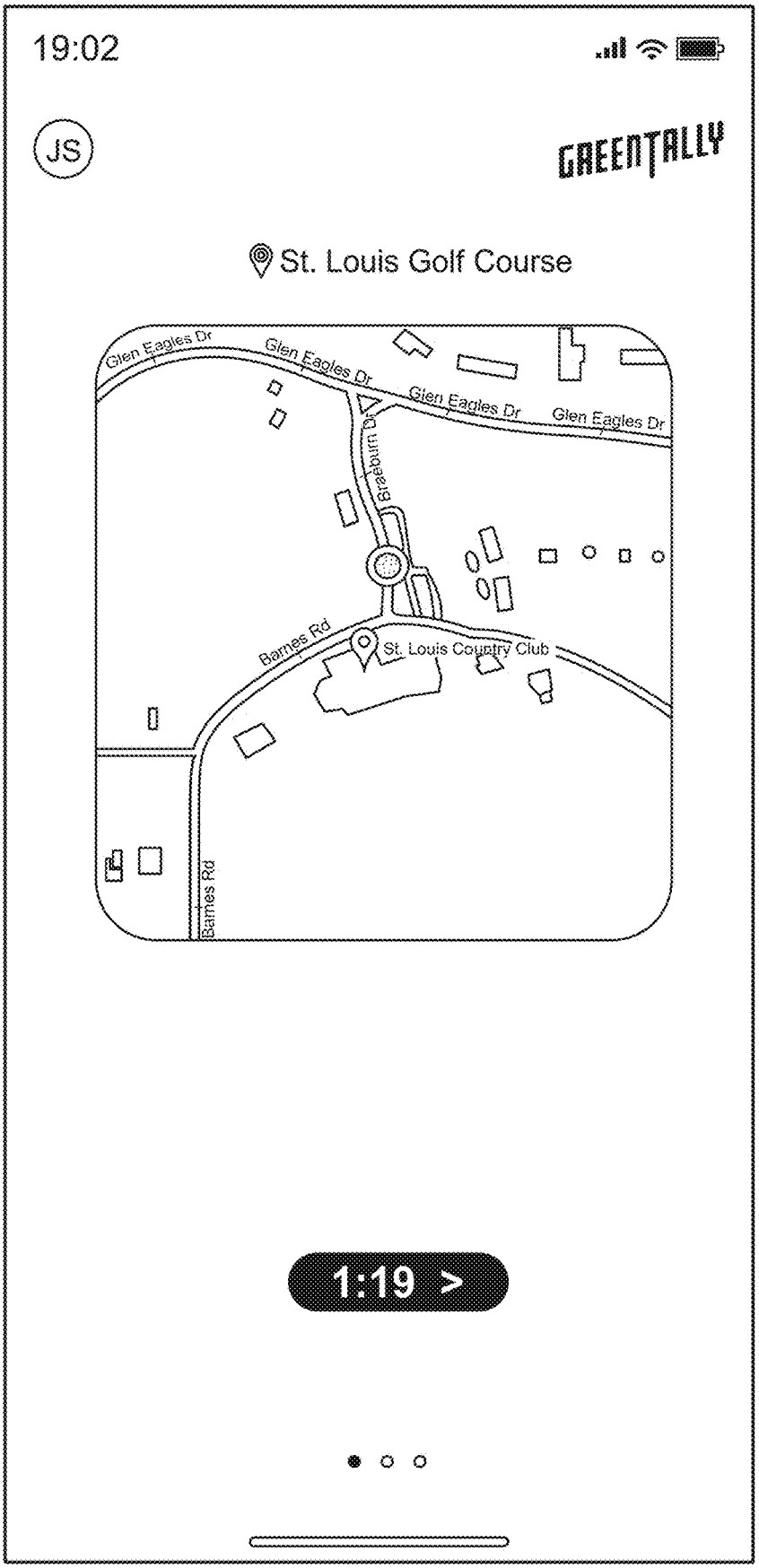

FIG. 29 illustrates the user's individual results page that includes the user's statistics by day, week, month and year, including putts, makes and related accuracy percentages for the user, including by distance, as well as corresponding PGA tour statistics. FIG. 30 illustrates a leaderboard page for accessing various leaderboards created by coaches, teaching professionals and others. FIG. 31 illustrates an example leaderboard for a college golf team, which may be based on coach-set parameters. For example, the leaderboard ranking may be determined based on accuracy inside ten feet to the cup as shown in FIG. 31, based on the most total made putts as shown in FIG. 32, etc. FIG. 33 illustrates a profile page that the user may employ to send and receive connection/friend requests, challenge requests, etc. Once connected, users can compete live with other users at the same or different locations. FIG. 34 illustrates an achievements screen showing various awards, milestones, earned badges, etc. The app may also include a screen showing the user's current location on a map, as shown in FIG. 37, as well as a payment screen via which users can submit payment, e.g., for use of the app.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A golf putting system, the system comprising:

a putt detector including one or more sensors and a control circuit to detect when golf balls are putted; and a cup detector including one or more sensors and a control circuit to detect when golf balls enter a putting hole;

wherein the putt detector and the cup detector are configured for wireless communication with one another;

wherein the putt detector is configured to determine a number of putts taken and a number of putts made in response to the putt detector detecting when golf balls are putted and the cup detector detecting when golf balls enter the putting hole; and wherein the putt detector is configured to determine and display a distance between the putt detector and the cup detector.

2. The system of claim 1 wherein the cup detector is removably attachable to the putt detector.

3. The system of claim 1 wherein the one or more sensors of the putt detector include a radar sensor or a 2D camera.

4. The system of claim 1 wherein the one or more sensors of the cup detector include a piezoelectric sensor or an accelerometer.

5. The system of claim 1 wherein the putt detector is configured to wirelessly transmit putting information to a smart device.

6. The system of claim 1 wherein the putt detector includes a display for displaying the number of putts taken and the number of putts made.

7. The system of claim 1 wherein the putt detector includes an accelerometer for detecting movement of the putt detector, and wherein the putt detector is configured to determine the distance between putt detector and the cup detector within a defined time period after the putt detector becomes stationary.

8. The system of claim 1 further comprising a flagstick, wherein the cup detector is coupled to the flagstick.

9. The system of claim 1 wherein the putt detector is configured to determine and display a distance between the putt detector and the cup detector using ultra-wideband (UWB) positioning.

10. The system of claim 1 wherein the cup detector is sized and configured for placement over the center hole of a standard golf cup.

11. An apparatus comprising:

one or more sensors and a control circuit to detect when golf balls are putted; and a wireless communication module configured to receive from another device data indicating when golf balls enter a putting hole;

wherein the control circuit is coupled to the wireless communication module and configured to determine a number of putts taken and a number of putts made in response to detecting when golf balls are putted and the data indicating when golf balls enter the putting hole; and wherein the apparatus is configured to determine and display a distance to the putting hole.

12. The apparatus of claim 11 wherein the one or more sensors include a radar sensor or a 2D camera.

13. The apparatus of claim 11 wherein the apparatus is configured to wirelessly transmit putting information to a smart device.

14. The apparatus of claim 11 further comprising a display for displaying the number of putts taken and the number of putts made.

15. The apparatus of claim 11 further comprising a UWB initiator.

16. The apparatus of claim 11 further comprising an accelerometer for detecting movement, wherein the apparatus is configured to determine the distance to the putting hole within a defined time period after the apparatus becomes stationary.

17. An apparatus comprising:

one or more sensors and a control circuit to detect when golf balls enter a putting hole;

a wireless communication module configured to send wireless data to another device indicating when golf balls enter the putting hole; and a UWB responder configured to send a wireless signal to said another device that enables said another device to determine a distance between said another device and the apparatus.

18. The apparatus of claim 17 wherein the one or more sensors include a piezoelectric sensor or an accelerometer.

19. The apparatus of claim 17 wherein the apparatus is sized and configured for placement over the center hole of a standard golf cup.

20. The apparatus of claim 17 further comprising a speaker for providing user feedback.

21. The apparatus of claim 17 wherein the apparatus is attached to or integrated with a flagstick.

* * * * *